US006860218B2

(12) United States Patent
Eagles et al.

(10) Patent No.: US 6,860,218 B2
(45) Date of Patent: Mar. 1, 2005

(54) FLEXIBLE FLUID CONTAINMENT VESSEL

(75) Inventors: Dana Eagles, Sherborn, MA (US); Crayton Gregory Toney, Wrentham, MA (US); Srinath Tupil, Chelmsford, MA (US); Donald Tripp Lawton, Wayland, MA (US); James G. Donovan, Norwell, MA (US); William Dutt, Wolfeboro, NH (US); Eric Romanski, Clifton Park, NY (US); Bjorn Rydin, Hörby (SE); Jan Rexfelt, Halmstad (SE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/832,739

(22) Filed: Apr. 11, 2001

(65) Prior Publication Data

US 2002/0148400 A1 Oct. 17, 2002

(51) Int. Cl.[7] ..... B65D 88/78
(52) U.S. Cl. ..... 114/256; 114/74 T
(58) Field of Search ..... 114/257, 256, 114/253, 74 R, 74 T

(56) References Cited

U.S. PATENT DOCUMENTS

| | | | |
|---|---|---|---|
| 34,426 | A | 2/1862 | Howard |
| 389,615 | A | 9/1888 | Townsend |
| 1,723,307 | A | 8/1929 | Sipe |

(List continued on next page.)

FOREIGN PATENT DOCUMENTS

| | | | |
|---|---|---|---|
| DE | 198 21 465 | A | 11/1999 |
| EP | 0 134 706 | A | 3/1985 |
| EP | 0 710 736 | A1 | 11/1994 |
| EP | 0 687 625 | | 12/1995 |
| EP | 0 862 870 | A | 9/1998 |
| EP | 0 832 032 | B1 | 4/1999 |
| FR | 2 325 837 | | 4/1977 |
| FR | 2595621 | | 9/1987 |
| GB | 824 984 | A | 12/1959 |
| GB | 826 301 | A | 12/1959 |
| GB | 933 889 | A | 8/1963 |
| GB | 1 079 766 | | 8/1967 |
| GB | 1117552 | | 6/1968 |
| GB | 1117553 | | 6/1968 |
| JP | 60 219243 | A | 11/1985 |
| WO | WO 97/14622 | A | 4/1997 |
| WO | WO 97/49541 | | 12/1997 |
| WO | WO 98/01359 | A | 1/1998 |

OTHER PUBLICATIONS

International Search Report issued by the European Patent Office on Feb. 6, 2003 for PCT/US02/34299.

(List continued on next page.)

*Primary Examiner*—Andrew Wright
(74) *Attorney, Agent, or Firm*—Frommer Lawrence & Haug LLP; Ronald R. Santucci

(57) ABSTRACT

A seamless, woven, flexible fluid containment vessel or vessels for transporting and containing a large volume of fluid, particularly fresh water, having beam stabilizers, beam separators, reinforcing, and the method of making the same.

61 Claims, 17 Drawing Sheets

U.S. PATENT DOCUMENTS

| | | | | |
|---|---|---|---|---|
| 1,921,015 | A | | 8/1933 | Young |
| 2,065,480 | A | | 12/1936 | Soper |
| 2,371,404 | A | | 3/1945 | Mumford |
| 2,391,926 | A | | 1/1946 | Scott |
| 2,492,699 | A | | 12/1949 | Houwink |
| 2,685,964 | A | | 8/1954 | Brown |
| 2,724,358 | A | | 11/1955 | Harris et al. |
| 2,725,027 | A | | 11/1955 | Brandon et al. |
| 2,794,192 | A | | 6/1957 | Paris |
| 2,854,049 | A | | 9/1958 | Wyllie |
| 2,968,272 | A | | 1/1961 | Berglund |
| 2,979,008 | A | | 4/1961 | Whipple |
| 2,997,973 | A | | 8/1961 | Hawthorne et al. |
| 2,998,793 | A | | 9/1961 | Hawthorne et al. |
| 3,001,501 | A | | 9/1961 | Hawthorne et al. |
| 3,018,748 | A | | 1/1962 | Denis et al. |
| 3,056,373 | A | | 10/1962 | Hawthorne et al. |
| 3,067,712 | A | | 12/1962 | Doerpinghaus |
| 3,150,627 | A | | 9/1964 | Stewart et al. |
| 3,167,103 | A | | 1/1965 | Hawthorne et al. |
| 3,224,403 | A | | 12/1965 | Paddington |
| 3,282,361 | A | | 11/1966 | Mackie |
| 3,289,721 | A | | 12/1966 | Benson |
| 3,296,994 | A | | 1/1967 | Schirtzinger |
| 3,502,046 | A | | 3/1970 | Stauber |
| 3,561,219 | A | * | 2/1971 | Nishizawa et al. ..... 405/19 |
| 3,622,437 | A | | 11/1971 | Hobaica et al. |
| 3,661,693 | A | | 5/1972 | Pierson |
| 3,672,319 | A | | 6/1972 | Platzer |
| 3,739,410 | A | | 6/1973 | Fortin |
| 3,762,108 | A | | 10/1973 | Pierson |
| 3,774,563 | A | | 11/1973 | Anderson, Sr. et al. |
| 3,779,196 | A | | 12/1973 | Knaus et al. |
| 3,797,445 | A | | 3/1974 | Zeimer |
| 3,812,805 | A | | 5/1974 | Forssell et al. |
| 3,839,977 | A | | 10/1974 | Bradberry |
| 3,952,679 | A | | 4/1976 | Grihangne |
| 3,955,524 | A | | 5/1976 | Renoux |
| 3,974,789 | A | | 8/1976 | de Groot |
| 4,108,101 | A | | 8/1978 | Schirtzinger |
| 4,227,474 | A | | 10/1980 | Ullrich |
| 4,227,477 | A | | 10/1980 | Preus |
| 4,227,478 | A | | 10/1980 | Preus |
| 4,230,061 | A | | 10/1980 | Roberts |
| 4,373,462 | A | | 2/1983 | Fish |
| 4,399,765 | A | | 8/1983 | Alkner et al. |
| 4,506,623 | A | | 3/1985 | Roper et al. |
| 4,509,558 | A | | 4/1985 | Slater |
| 4,510,201 | A | | 4/1985 | Takeuchi et al. |
| 4,582,756 | A | | 4/1986 | Niinuma et al. |
| 4,662,386 | A | | 5/1987 | Pedersen |
| 4,668,545 | A | * | 5/1987 | Lowe ..... 428/36.1 |
| 4,726,986 | A | | 2/1988 | Cannady, Jr. et al. |
| 4,910,817 | A | | 3/1990 | Kita |
| 4,933,231 | A | | 6/1990 | Seber |
| 4,998,498 | A | | 3/1991 | Gallichan |
| 5,082,726 | A | | 1/1992 | Bastiaens et al. |
| 5,194,459 | A | | 3/1993 | Sato et al. |
| 5,203,272 | A | | 4/1993 | Kassinger et al. |
| 5,235,928 | A | | 8/1993 | Shank, Jr. |
| 5,243,925 | A | | 9/1993 | Fortenberry |
| 5,262,230 | A | | 11/1993 | Becker et al. |
| 5,355,819 | A | | 10/1994 | Hsia et al. |
| 5,360,656 | A | | 11/1994 | Rexfelt et al. |
| 5,391,424 | A | | 2/1995 | Kolzer |
| 5,413,065 | A | | 5/1995 | Spragg et al. |
| 5,421,128 | A | | 6/1995 | Sharpless et al. |
| 5,431,970 | A | | 7/1995 | Broun et al. |
| 5,482,763 | A | | 1/1996 | Shaffer |
| 5,488,921 | A | | 2/1996 | Spragg |
| 5,503,291 | A | | 4/1996 | Craig |
| 5,505,557 | A | | 4/1996 | Bradley |
| 5,544,612 | A | | 8/1996 | Eymard |
| 5,657,714 | A | | 8/1997 | Hsia et al. |
| 5,691,390 | A | | 11/1997 | Harrison et al. |
| 5,713,399 | A | | 2/1998 | Collette et al. |
| 5,735,083 | A | | 4/1998 | Brown et al. |
| 5,780,144 | A | | 7/1998 | Bradley |
| 5,790,304 | A | | 8/1998 | Sanders et al. |
| 5,865,045 | A | | 2/1999 | Wagner et al. |
| 5,902,070 | A | | 5/1999 | Bradley |
| 5,921,421 | A | | 7/1999 | Fuquan |
| 5,951,345 | A | | 9/1999 | Perratone et al. |
| 6,003,565 | A | | 12/1999 | Whittier, II et al. |
| 6,047,655 | A | | 4/2000 | Cran |
| 6,056,438 | A | | 5/2000 | Bradley |
| 6,086,968 | A | | 7/2000 | Horovitz |
| 6,101,964 | A | | 8/2000 | Lesesne |

* cited by examiner

OTHER PUBLICATIONS

International Search Report issued by the European Patent Office on Feb. 10, 2003 for PCT/US02/34052.

International Search Report issued by European Patent Office for corresponding international application PCT/US02/10586 mailed Sep. 26, 2002.

"3–D Braided Composites—Design and Applications" by D. Brookstein, 6th European Conference on Composite Materials, Sep. 1993, pp. 225–230.

Pages from web site of Bradley Industrial Textiles, Inc.

International Search Report issued by European Patent Office on Jul. 9, 2002 for PCT/US02/10694 filed Apr. 5, 2002.

*McGraw–Hill Encyclopedia of Science and Technology, 6th edition*, 1987, McGraw–Hill Book Company, New York XP002203699 18 pp. 247–248 Paragraph 4; figures 6–8.

FLEXIBLE FLUID CONTAINMENT VESSEL

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and the method of making the same.

BACKGROUND OF THE INVENTION

The use of flexible containers for the containment and transportation of cargo, particularly fluid or liquid cargo, is well known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost involved in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

For example, currently an icecap harvester intends to use tankers having 150 ton capacity to transport fresh water. Obviously, this involves, not only the cost involved in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are known to be a source of bag failure when the bag is repeatedly subjected to high loads. Seam failure can obviously be avoided in a seamless structure.

Other problems face the use of large transport containers. In this regard, when partially or completely filled flexible barges or transport containers are towed through salt water, problems as to instability are known to occur. This instability is described as a flexural oscillation of the container and is directly related to the flexibility of the partially or completely filled transport container. This flexural oscillation is also known as snaking. Long flexible containers having tapered ends and a relatively constant circumference over most of their length are known for problems with snaking. Snaking is described in U.S. Pat. No. 3,056,373, observing that flexible barges having tapered ends, build up to damaging oscillations capable of seriously rupturing or, in extreme cases, destroying the barge, when towed at a speed above a certain critical speed. Oscillations of this nature were thought to be set up by forces acting laterally on the barge towards its stern. A solution suggested was to provide a device for creating breakaway in the flow lines of the water passing along the surface of the barge and causing turbulence in the water around the stern. It is said that such turbulence would remove or decrease the forces causing snaking, because snaking depends on a smooth flow of water to cause sideways movement of the barge.

Other solutions have been proposed for snaking by, for example, U.S. Pat. Nos. 2,998,973; 3,001,501; and 3,056,373. These solutions include drogues, keels and deflector rings, among others.

Another solution for snaking is to construct the container with a shape that provides for stability when towing. A company known as Nordic Water Supply located in Norway has utilized this solution. Flexible transport containers utilized by this company have a shape that can be described as an elongated hexagon. This elongated hexagon shape has been shown to provide for satisfactory stable towing when transporting fresh water on the open sea. However, such containers have size limitations due to the magnitude of the forces placed thereon. In this regard, the relationship of towing force, towing speed and fuel consumption for a container of given shape and size comes into play. The operator of a tugboat pulling a flexible transport container desires to tow the container at a speed that minimizes the cost to transport the cargo. While high towing speeds are attractive in terms of minimizing the towing time, high towing speeds result in high towing forces and high fuel consumption. High towing forces require that the material used in the construction of the container be increased in strength to handle the high loads. Increasing the strength typically is addressed by using thicker container material. This, however, results in an increase in the container weight and a decrease in the flexibility of the material. This, in turn, results in an increase in the difficulty in handling the flexible transport container, as the container is less flexible for winding and heavier to carry.

Moreover, fuel consumption rises rapidly with increased towing speed. For a particular container, there is a combination of towing speed and fuel consumption that leads to a minimum cost for transportation of the cargo. Moreover, high towing speeds can also exacerbate problems with snaking.

In the situation of the elongated hexagon shaped flexible transport containers used in the transport of fresh water in the open sea, it has been found, for a container having a capacity of 20,000 cubic meters, to have an acceptable combination of towing force (about 8 to 9 metric tons), towing speed (about 4.5 knots) and fuel consumption. Elongated hexagon shaped containers having a capacity of 30,000 cubic meters are operated at a lower towing speed, higher towing force and higher fuel consumption than a 20,000 cubic meter cylindrical container. This is primarily due to the fact that the width and depth of the larger elongated hexagon must displace more salt water when pulled through open sea. Further increases in container capacity are desirable in order to achieve an economy of scale for the transport operation. However, further increases in the capacity of elongated hexagon shaped containers will result in lower towing speeds and increased fuel consumption.

The aforenoted concerning snaking, container capacity, towing force, towing speed and fuel consumption defines a need for an improved flexible transport container design. There exists a need for an improved design that achieves a combination of stable towing (no snaking), high FFCV capacity, high towing speed, low towing force and low fuel consumption relative to existing designs.

In addition, to increase the volume of cargo being towed, it has been suggested to tow a number of flexible containers together. Such arrangements can be found in U.S. Pat. Nos. 5,657,714; 5,355,819; and 3,018,748 where a plurality of containers are towed in line one after another. So as to increase stability of the containers, EPO 832 032 B1 discloses towing multiple containers in a pattern side by side.

However, in towing flexible containers side by side, lateral forces caused by ocean wave motion creates instability which results in one container pushing into the other and rolling end over end. Such movements have a damaging effect on the containers and also effect the speed of travel.

Another problem with such flexible containers is the large towing forces thereon, in addition to the forces created by extreme sea and wind conditions. Accordingly, it is imperative that ruptures in the container be avoided, otherwise the entire cargo could become compromised. Reinforcing the container against such failures is desirable and various means for reinforcing the container have been proposed. These typically include the attachment of ropes to the outer surface of the container, as can be seen in, for example, U.S. Pat. Nos. 2,979,008 and 3,067,712. Reinforcement strips and ribs cemented to the outer surface of the container have also been envisioned, as disclosed in U.S. Pat. No. 2,391,926. Such reinforcements, however, suffer the disadvantages of requiring their attachment to the container while also being cumbersome, especially if the container is intended to be wound up when emptied. Moreover, external reinforcements on the container's surface provide for increased drag during towing. While reinforcements are very desirable, especially if a somewhat light weight fabric is envisioned, the manner of reinforcement needs to be improved upon.

Furthermore, while as aforenoted, a seamless flexible container is desirable and has been mentioned in the prior art, the means for manufacturing such a structure has its difficulties. Heretofore, as noted, large flexible containers were typically made in smaller sections which were sewn or bonded together. These sections had to be water impermeable. Typically such sections, if not made of an impermeable material, could readily be provided with such a coating prior to being installed. The coating could be applied by conventional means such as spraying or dip coating.

For larger coated fabrics (i.e. 40'×200'), it is possible to coat them using a large two roll liquid coating system. Although large, these fabrics are not as large as required for FFCVs. It is economically impractical to build a roll system to coat a fabric of the large size envisioned.

As distinct from the roll system, impermeable fabrics have also traditionally been made by applying a liquid coating to a woven or non-woven base structure and then curing or setting the coating via heat or a chemical reaction. The process involves equipment to tension and support the fabric as the coating is being applied and ultimately cured. For fabrics in the size range of 100" in width, conventional coating lines are capable of handling many hundreds or thousands of feet. They involve the use of support rolls, coating stations and curing ovens that will handle woven substrates that fall within the 100" width.

However, with an extremely large flexible woven seamless container, in order of 40' diameter and 1000' in length or larger, conventional coating methods would be difficult. While relatively small flat fabrics are readily coated, a tubular unitary structure, extremely long and wide, is much more difficult.

Accordingly, there exist a need for a FFCV for transporting large volumes of fluid which overcomes the aforenoted problems attendant to such a structure and the environment in which it is to operate.

SUMMARY OF THE INVENTION

It is therefore a principal object of the invention to provide for a relatively large seamless woven FFCV for the transportation of cargo, including, particularly, fresh water, having a density less than that of salt water.

It is a further object of the invention to provide for such an FFCV which has means of inhibiting the undesired snaking thereof during towing.

It is a further object of the invention to provide means for allowing the transportation of a plurality of such FFCVs.

A further object of the invention is to provide for a means for reinforcing of such an FFCV so as to effectively distribute the load thereon and inhibit rupture.

A yet further object is to provide for a method of coating the woven tube used in the FFCV or otherwise rendering it impermeable.

These and other objects and advantages will be realized by the present invention. In this regard the present invention envisions the use of a seamless woven tube to create the FFCV, having a length of 300' or more and a diameter of 40' or more. Such a large structure can be woven on existing machines that weave papermaker's clothing such as those owned and operated by the assignee hereof. The ends of the tube, sometimes referred to as the nose and tail, or bow and stern, are sealed by any number of means, including being folded over and bonded and/or stitched with an appropriate tow bar attached at the nose. Examples of end portions in the prior art can be found in U.S. Pat. Nos. 2,997,973; 3,018,748; 3,056,373; 3,067,712; and 3,150,627. An opening or openings are provided for filling and emptying the cargo such as those disclosed in U.S. Pat. Nos. 3,067,712 and 3,224,403.

In order to reduce the snaking effect on such a long structure, a plurality of longitudinal stiffening beams are provided along its length. These stiffening beams are intended to be pressurized with air or other medium. The beams are preferably woven as part of the tube but also may be woven separately and maintained in sleeves woven as part of the FFCV. They may also be braided in a manner as set forth in U.S. Pat. Nos. 5,421,128 and 5,735,083 or in an article entitled "3-D Braided Composites-Design and Applications" by D. Brookstein, $6^{th}$ European Conference on Composite Materials, September 1995. They can also be knit or laid up as an integral part of the textile structure used to make the tube. The entire structure is preferably made as one piece (unitized construction). Attaching or fixing such beams by sewing is also possible, however, unitized construction is preferred due to the ease of manufacturing and its greater strength.

Stiffening or reinforcement beams of similar construction as noted above may also be provided at spaced distances about the circumference of the tube.

The beams also provide buoyancy to the FFCV as the cargo is unloaded to keep it afloat, since the empty FFCV would normally be heavier than salt water. Valves may be provided which allow pressurization and depressurization as the FFCV is wound up for storage.

In the situation where more than one FFCV is being towed, it is envisioned that one way is that they be towed side by side. To increase stability and avoid "roll over", a plurality of beam separators, preferably containing pressurized air or other medium, would be used to couple adjacent FFCVs together along their length. The beam separators can be affixed to the side walls of the FFCV by way of pin seam connectors or any other means suitable for purpose.

Another way would be by weaving an endless or seamless series of FFCVs interconnected by a flat woven portion.

In addition, the present invention includes fiber reinforcements woven into the tube used to construct the FFCV. These reinforcement fibers can be spaced in the longitudinal direction about the circumference of the tube and in the vertical direction along the length of the tube. In addition to providing reinforcement, such an arrangement may allow for the use of a lighter weight fabric in the construction of the tube. Since they are woven into the fabric, external means for affixing them are not necessary nor do they create additional drag during towing.

Reinforcement may also take the form of woven pockets in the tube to receive lengthwise and circumferential reinforcing ropes or wires which will address the load requirements on the FFCV while preserving its shape.

The present invention also discloses methods rendering the tube impervious. In this regard various methods are proposed so as to allow for conventional coating to be used, i.e. spray, dip coating, etc. The tube can be coated on the inside, outside, or both with an impervious material. The tube, if the weave is tight enough, may be inflated with the outside spray coated. A non-stick bladder may be inserted, if necessary, to allow the coating of the outside. The bladder is then removed and the tube can be inflated and the inside coated. Alternatively, a flat non-stick liner can be inserted into the tube to prevent the sticking of the interior surface during coating and thereafter it is removed. Also, mechanical means may be inserted within the tube during coating to keep the interior surfaces apart during coating.

Alternatively, the tube may be woven with a fiber having a thermoplastic coating or with thermoplastic fibers interdispersed within the weave. The tube would then be subject to heat and pressure so as to cause the thermoplastic material to fill the voids in the weave and create an impermeable tube. An apparatus that provides for accomplishing this is also disclosed.

BRIEF DESCRIPTION OF THE DRAWINGS

Thus by the present invention its objects and advantages will be realized, the description of which should be taken in conjunction with the drawings, wherein:

FIG. 2I is a somewhat general perspective view of a FFCV having a flattened bow which is orthogonal to the stern incorporating the teachings of the present invention;

DETAILED DESCRIPTION OF THE PREFERRED EMBODIMENTS

Figure 2:
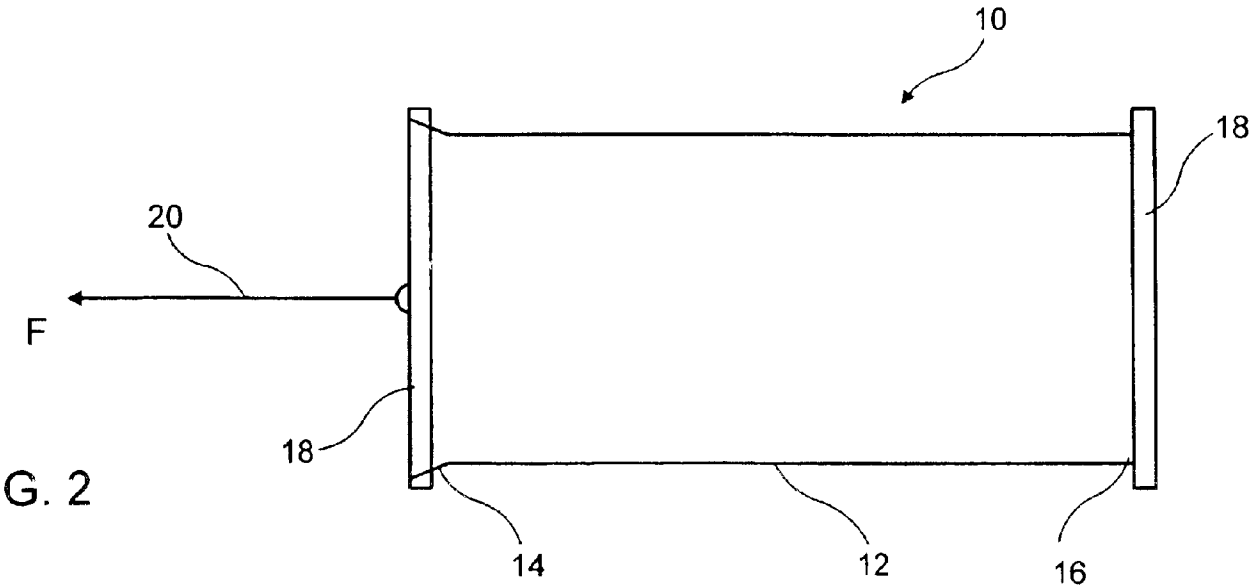
FIG. 2 is a somewhat general perspective view of a FFCV which is cylindrical having a flattened bow or nose incorporating the teachings of the present invention.

The proposed FFCV 10 is intended to be constructed of a seamless woven impermeable textile tube. The tube's configuration may vary. For example, as shown in FIG. 2, it would comprise a tube 12 having a substantially uniform diameter (perimeter) and sealed on each end 14 and 16. It can also have a non-uniform diameter or non-uniform shape. See FIG. 5. The respective ends 14 and 16 may be closed, pinched, and sealed in any number of ways, as will be discussed. The resulting coated structure will also be flexible enough to be folded or wound up for transportation and storage.

Before discussing more particularly the FFCV design of the present invention, it is important to take into consideration certain design factors. The even distribution of the towing load is crucial to the life and performance of the FFCV. During the towing process there are two types of drag forces operating on the FFCV, viscous drag and form drag forces. The total force, the towing load, is the sum of the viscous and form drag forces. When a stationary filled FFCV is initially moved, there is an inertial force experienced during the acceleration of the FFCV to constant speed. The inertial force can be quite large in contrast with the total drag force due to the large amount of mass being set in motion. It has been shown that the drag force is primarily determined by the largest cross-section of the FFCV profile, or the point of largest diameter. Once at constant speed the inertial tow force is zero and the total towing load is the total drag force.

As part of this, and in addition thereto, it has been determined that to increase the volume of the FFCV, it is more efficient to increase its length than it is to increase both its length and width. For example, a towing force as a function of towing speed, has been developed for a cylindrically shaped transport bag having a spherically shaped bow and stern. It assumes that the FFCV is fully submersed in water. While this assumption may not be correct for a cargo that has a density less than salt water, it provides a means to estimate relative effects of the FFCV design on towing requirements. This model estimates the total towing force by calculating and adding together two components of drag for a given speed. The two components of drag are viscous drag and form drag. The formulae for the drag components are shown below.

$$\text{Viscous Drag (tons)}=(0.25*(A4+D4)*(B4+(3.142*C4))*E4\hat{}1.63/8896$$

$$\text{Form Drag (tons)}=(((B4-(3.14*C4/2))*C4/2)\hat{}1.87)*E4\hat{}1.33*1.133/8896$$

$$\text{Total towing force (tons)}=\text{Viscous drag (tons)}+\text{Form drag (tons)}$$

where A4 is the overall length in meters, D4 is the total length of the bow and stern sections in meters, B4 is the perimeter of the bag in meters, C4 is the draught in meters and E4 is the speed in knots.

The towing force for a series of FFCV designs can now be determined. For example, assume that the FFCV has an overall length of 160 meters, a total length of 10 meters for the bow and stern sections, a perimeter of 35 meters, a speed of 4 knots and the bag being filled 50%. The draught in meters is calculated assuming that the cross sectional shape of the partially filled FFCV has a racetrack shape. This shape assumes that the cross section looks like two half circles joined to a rectangular center section. The draught for this FFCV is calculated to be 3.26 meters. The formula for the draught is shown below.

$$\text{Draught (meters)}=B4/3.14*(1-((1-J4)\hat{}0.5))$$

where J4 is the fraction full for the FFCV (50% in this case).

For this FFCV the total drag is 3.23 tons. The form drag is 1.15 tons and the viscous drag is 2.07 tons. If the cargo was fresh water, this FFCV would carry 7481 tons at 50% full.

If one desires a FFCV that can carry about 60,000 tons of water at 50% full, the FFCV capacity can be increased in at least two ways. One way is to scale up the overall length, total length of the bow and stern sections and perimeter by an equal factor. If these FFCV dimensions are increased by a factor of 2, the FFCV capacity at 50% full is 59,846 tons. The total towing force increases from 3.23 tons for the prior FFCV to 23.72 tons for this FFCV. This is an increase of 634%. The form drag is 15.43 tons (an increase of 1241%) and the viscous drag is 8.29 tons (an increase of 300%). Most of the increase in towing force comes from an increase in the form drag which reflects the fact that this design requires more salt water to be displaced in order for the FFCV to move through the salt water.

An alternative means to increase the capacity to 60,000 tons is to lengthen the FFCV while keeping the perimeter, bow and stern dimensions the same. When the overall length is increased to 1233.6 meters the capacity at 50% fill is 59,836 tons. At a speed of 4 knots the total drag force is 16.31 tons or 69% of the second FFCV described above. The form drag is 1.15 tons (same as the first FFCV) and the viscous drag is 15.15 tons (an increase of 631% over the first FFCV).

This alternative design (an elongated FFCV of 1233.6 meters) clearly has an advantage in terms of increasing capacity while minimizing any increase in towing force. The elongated design will also realize much greater fuel economy for the towing vessel relative to the first scaled up design of the same capacity.

With the preferred manner of increasing the volume of the FFCV having been determined, we turn now to the general construction of the tube 12 which will make up the FFCV. The present invention envisions weaving the tube 12 in a seamless fashion on a large textile loom of the type typically used for weaving seamless papermaker's cloth or fabric. The tube 12 is woven on a loom having a width of about 96 feet. With a loom having such a width, the tube 12 would have a diameter of approximately 92 feet. The tube 12 could be woven to a length of 300 feet or more. The tube as will be discussed will have to be impervious to salt water or diffusion of salt ions. Once this is done, the ends of the tubes are sealed. Sealing is required not only to enable the structure to contain water or some other cargo, but also to provide a means for towing the FFCV.

Sealing can be accomplished in many ways. The sealed end can be formed by collapsing the end 14 of the tube 12 and folded over one or more times as shown in FIG. 2. One end 14 of the tube 12 can be sealed such that the plane of the sealed surface is, either in the same plane as the seal surface at the other end 16 of the tube. Alternatively, end 14 can be orthogonal to the plane formed by the seal surface at the other end 16 of the tube, creating a bow which is perpendicular to the surface of the water, similar to that of a ship. (See FIG. 2I). For sealing the ends 14 and 16 of the tube are collapsed such that a sealing length of a few feet results. Sealing is facilitated by gluing or sealing the inner surfaces of the flattened tube end with a reactive material or adhesive. In addition, the flattened ends 14 and 16 of the tube can be clamped and reinforced with metal or composite bars 18 that are bolted or secured through the composite structure. These metal or composite bars 18 can provide a means to attach a towing mechanism 20 from the tugboat that tows the FFCV.

Figure 2A:
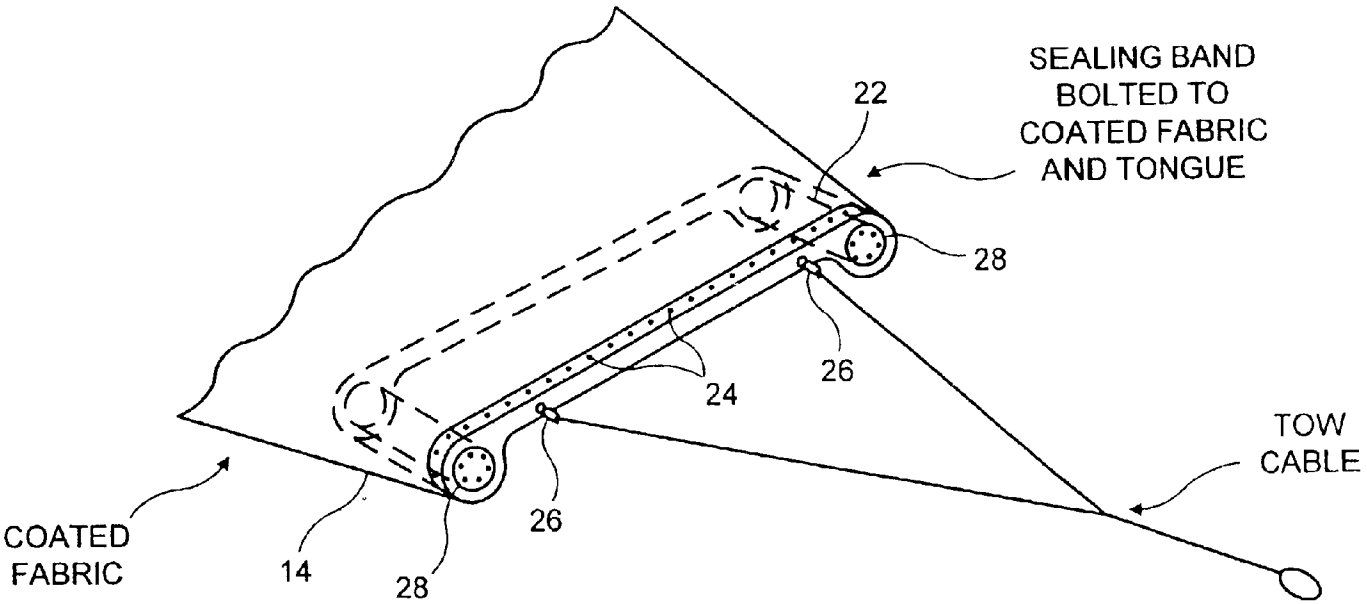
FIG. 2A is a somewhat general perspective view of a tongue arrangement sealing the bow or nose of the FFCV incorporating the teachings of the present invention.
Figure 2B:
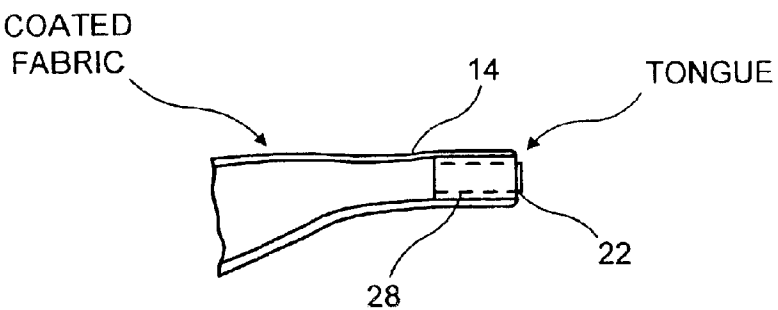
FIG. 2B is a side section view of the bow of the FFCV shown in FIG. 2A incorporating the teachings of the present invention.

In addition, as shown in FIGS. 2A and 2B, a metal or composite article, which will be called a tongue 22, can be inserted into and at the end of the tube 12 prior to sealing. The tongue 22 would be contoured to match the shape of the tube end when the tube end is either fully open, partially collapsed, or fully collapsed. The end 14 of the tube 12 would be sealed around the tongue with an adhesive or glue. The tongue would be secured in place with bolts 24 or some other suitable means. The tongue would be bolted not only to the end of the coated tube, but also to any exterior metal plate or composite support device. The tongue could also be fitted with fixtures for towing the FFCV. The tongue could also be fitted with one or more ports or pipes 28 that can be used to either vent the FFCV, fill the FFCV with water, or empty the FFCV of water. These pipes can be made such that pumps connected to a discharge pipe and external power supply can be inserted into the FFCV and be used to empty the FFCV of water.

Figure 2C:
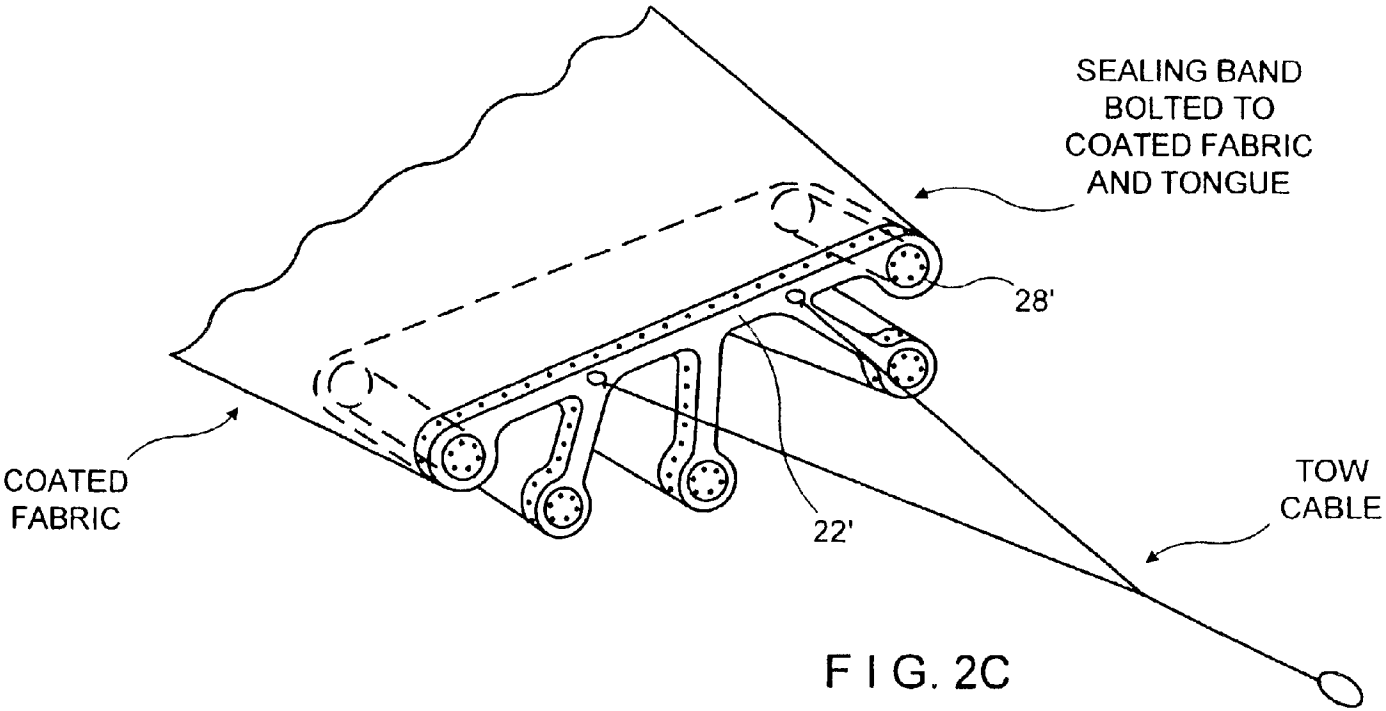
FIGS. 2C and 2D show an alternative tongue arrangement to that shown in FIGS. 2A and 2B incorporating the teachings of the present invention.
Figure 2D:
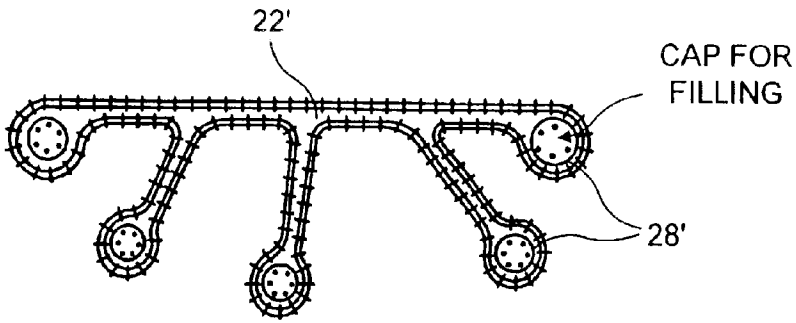

Other configurations for the construction of the tongue are possible such as the five prong tongue 22' shown in FIGS. 2C and 2D. The tongue 22' would be similarly attached to the tube 12 as discussed with each of the prongs having ports 28' for filling, emptying, or venting. As with each tongue arrangement, it is sized to have an outer surface perimeter to match that of the end of the tube 12.

An alternative to a tongue arrangement is a pin seam structure that can be created in the sealed end. A way to do this is to make use of the lead and trailing edges of the FFCV to form seams such as a pin seam. A pin seam could be made by starting off the weaving of the tube by first weaving a flat fabric for a length of about 10 feet. The loom configuration would then be changed to transition into a tubular fabric and then at the opposite end changed back to a flat fabric for about 10 feet. After coating the flat end of the tube, it is folded back onto itself to form a closed loop. This loop would be fixed in place by fastening together the two pieces of coated fabric that come in contact to form the loop. These pieces could be fastened with bolts and reinforced with a composite or metal sheet. The closed loop would be machined or cut such that it formed a series of equally sized, looped fingers with spaces between the fingers. These spaces would have a width slightly larger than the width of a looped finger. The looped fingers form one end of a pin seam that can be meshed with another set of looped fingers from another FFCV. Once the looped fingers are meshed from the two ends of two FFCVs, a rope or pintle would be inserted in the loops and fixed in place. This pin seam can be used for attaching a towing mechanism. Alternatively, it can provide a means for joining together two FFCVs. The two FFCVs can be joined together quickly and disconnected quickly by this means of joining.

Figure 2E:
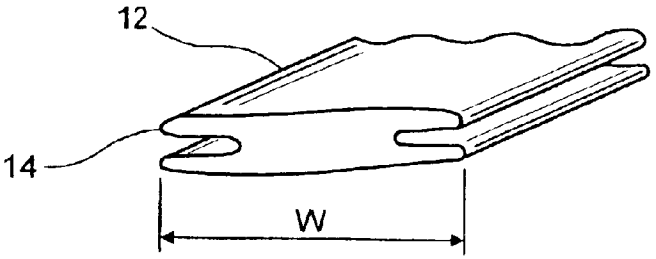
FIG. 2E is a somewhat general perspective view of a collapsed and folded end portion of the FFCV prior to sealing incorporating the teachings of the present invention.

An alternative to forming a simple collapsed and sealed end involves both collapsing and folding the end 14 of the tube 12 such that the width W of the sealed end matches either the diameter of the tube or the width of the tube when the tube is filled with water and floated in sea water. The general configuration of the collapsed and folded end is shown in FIG. 2E. This feature of matching the width of the sealed end with either the width of the tube or diameter of the tube as filled will minimize stress concentration when the FFCV is being towed.

The end 14 (collapsed and folded) will be sealed with a reactive polymer sealant or adhesive. The sealed end can also be reinforced as previously discussed with metal or composite bars to secure the sealed end and can be provided with a means for attaching a towing device. In addition, a metal or composite tongue, as discussed earlier, can be inserted into and at the end of the tube prior to sealing. The tongue would be contoured to match the shape of the tube end when the tube end is collapsed and folded.

Figure 1:
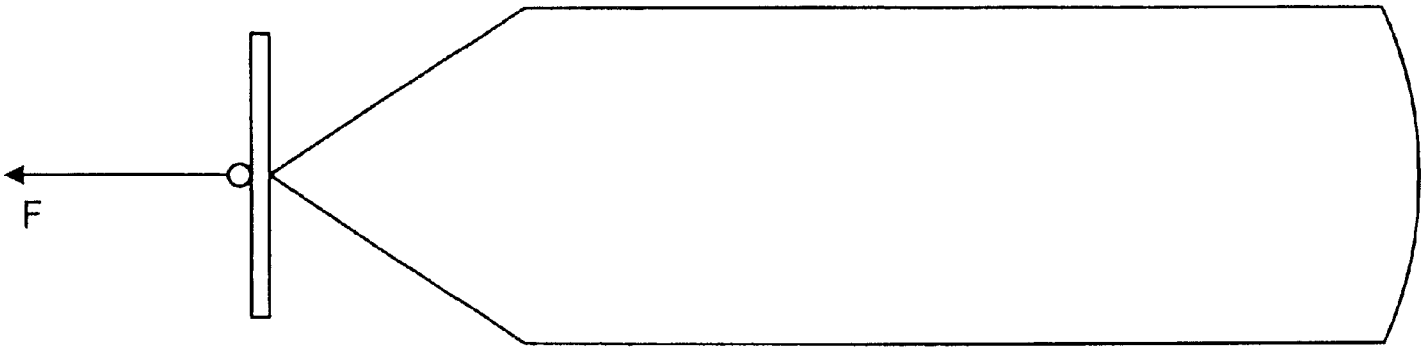
FIG. 1 PRIOR ART
FIG. 1 is a somewhat general perspective view of a prior art FFCV which is cylindrical having a pointed bow or nose.
Figure 2F:
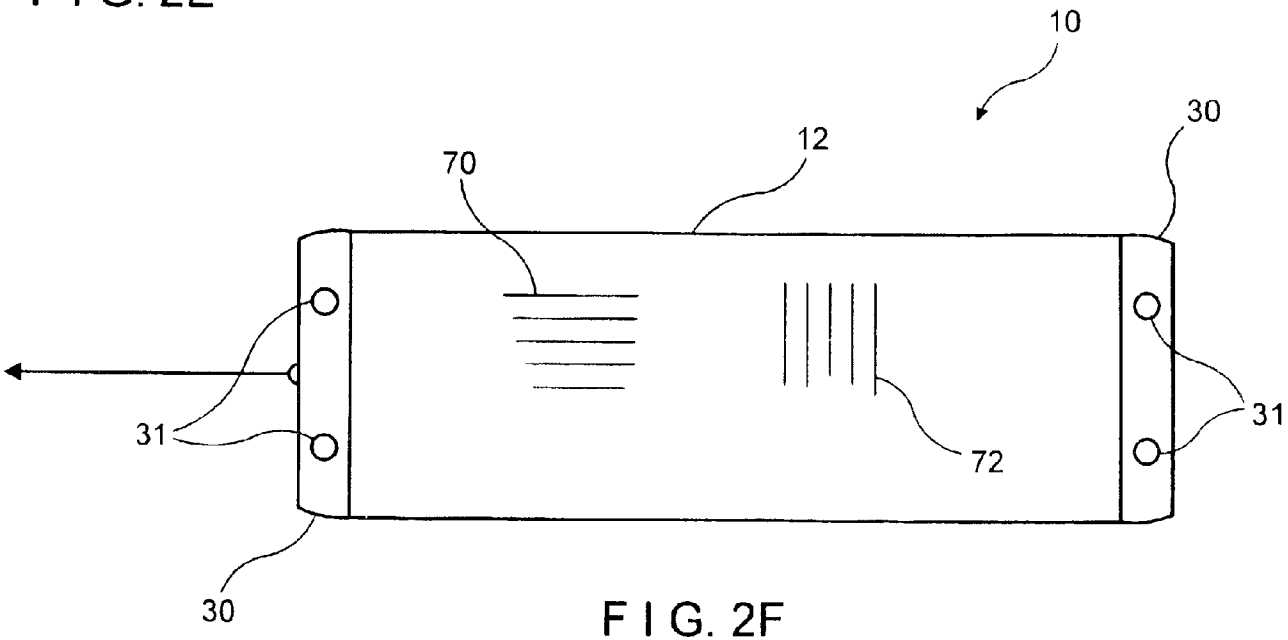
FIG. 2F is a somewhat general perspective view of a FFCV having blunt end caps on its bow and stern incorporating the teachings of the present invention.

Another means for sealing the ends involves attaching metal or composite end caps 30 as shown in FIG. 2F. In this embodiment, the size of the caps will be determined by the perimeter of the tube. The perimeter of the end cap 30 will be designed to match the perimeter of the inside of the tube 12 and will be sealed therewith by gluing, bolting or any other means suitable for purpose. The end cap 30 will serve as the sealing, filling/emptying via ports 31, and towing attachment means. The FFCV is not tapered, rather it has a more "blunt" end with the substantially uniform perimeter which distributes the force over the largest perimeter, which is the same all along the length, instead of concentrating the forces on the smaller diameter, neck area of prior art FFCV (see FIG. 1). By attaching a tow cap that matches the perimeter it ensures a more equal distribution of forces, particularly start up towing forces, over the entire FFCV structure.

Figure 2G:
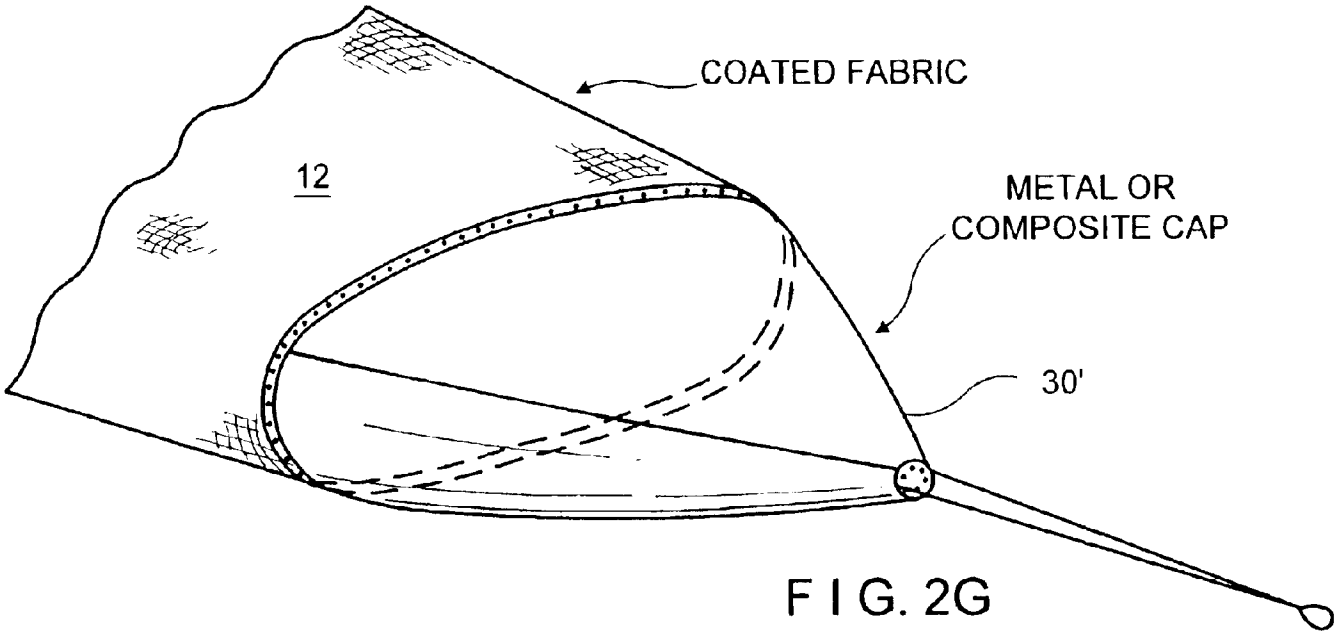
FIGS. 2G and 2H show an alternative end cap arrangement to that shown in FIG. 2F incorporating the teachings of the present invention.
Figure 2H:
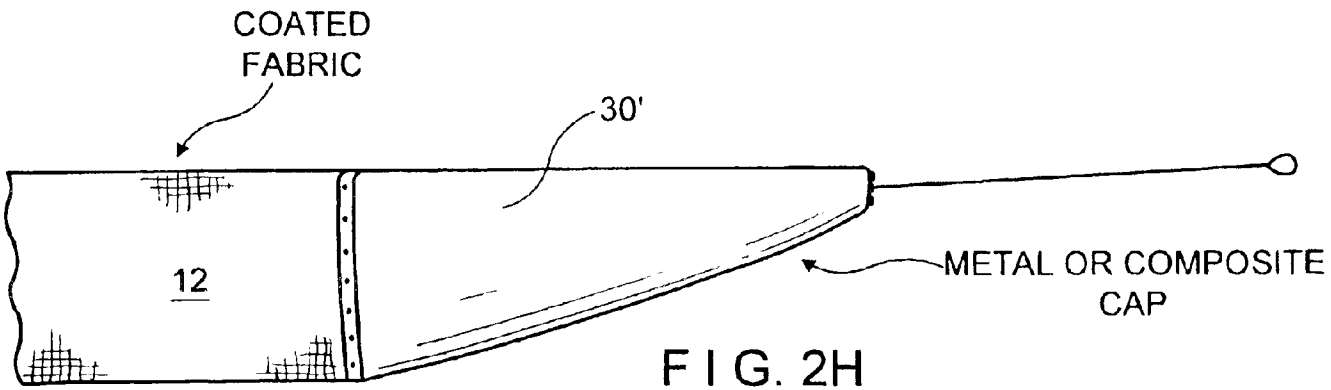
Figure 21:
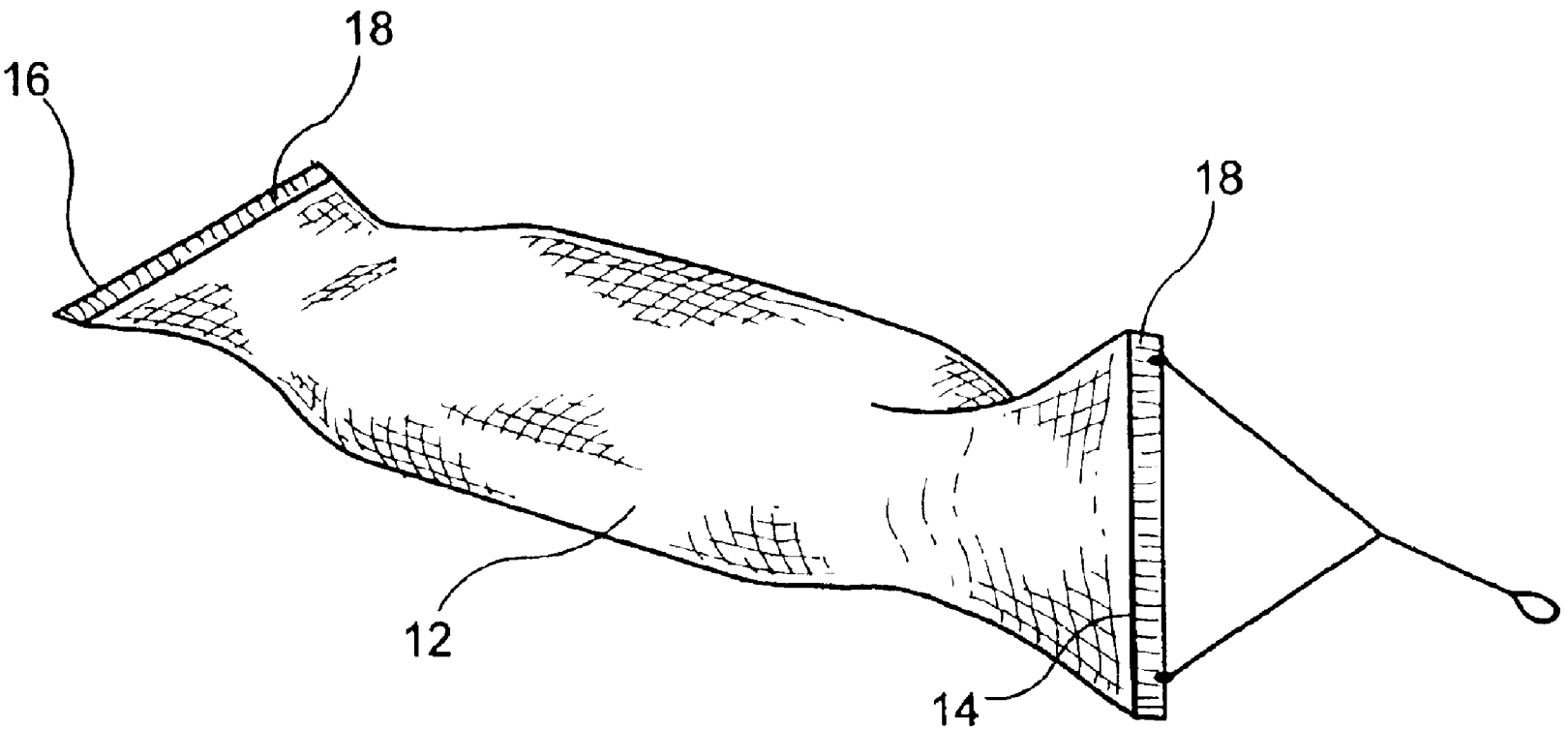

An alternative design of an end cap is shown in FIGS. 2G and 2H. The end cap 30' shown is also made of metal or composite material and is glued, bolted or otherwise sealed to tube 12. As can be seen, while being tapered, the rear portion of cap 30' has a perimeter that matches the inside perimeter of the tube 12 which provides for even distribution of force thereon.

The collapsed approach, the collapsed and folded configuration for sealing, the tongue approach, or the end cap approach can be designed to distribute, rather than concentrate, the towing forces over the entire FFCV and will enable improved operation thereof.

Having already considered towing forces to determine the shape which is more efficient i.e. longer is better than wider, and the means for sealing the ends of the tube, we turn now to a discussion of the forces on the FFCV itself in material selection and construction.

The forces that may occur in a FFCV can be understood from two perspectives. In one perspective, the drag forces for a FFCV traveling through water over a range of speeds can be estimated. These forces can be distributed evenly throughout the FFCV and it is desirable that the forces be distributed as evenly as possible. Another perspective is that the FFCV is made from a specific material having a given thickness. For a specific material, the ultimate load and elongation properties are known and one can assume that this material will not be allowed to exceed a specific percentage of the ultimate load. For example, assume that the FFCV material has a basis weight of 1000 grams per square meter and that half the basis weight is attributed to the textile material (uncoated) and half to the matrix or coating material with 70% of the fiber oriented in the lengthwise direction of the FFCV. If the fiber is, for example, nylon 6 or nylon 6.6 having a density of 1.14 grams per cubic centimeter, one can calculate that the lengthwise oriented nylon comprises about 300 square millimeters of the FFCV material over a width of 1 meter. Three hundred (300) square millimeters is equal to about 0.47 square inches. If one assumes that the nylon reinforcement has an ultimate breaking strength of 80,000 pounds per square inch, a one meter wide piece of this FFCV material will break when the load reaches 37,600 lbs. This is equivalent to 11,500 pounds per lineal foot. For a FFCV having a diameter of 42 ft. the circumference is 132 ft. The theoretical breaking load for this FFCV would be 1,518,000 lbs. Assuming that one will not exceed 33% of the ultimate breaking strength of the nylon reinforcement, then the maximum allowable load for the FFCV would be about 500,000 lbs or about 4,000 pounds per lineal foot (333 pounds per lineal inch). Accordingly, load requirement can be determined and should be factored into material selection and construction techniques.

Also, the FFCV will experience cycling between no load and high load. Accordingly, the material's recovery properties in a cyclical load environment should also be considered in any selection of material. The materials must also withstand exposure to sunlight, salt water, salt water temperatures, marine life and the cargo that is being shipped. The materials of construction must also prevent contamination of the cargo by the salt water. Contamination would occur, if salt water were forced into the cargo or if the salt ions were to diffuse into the cargo.

With the foregoing in mind, the present invention envisions FFCVs being constructed from coated textiles. Coated textiles have two primary components. These components are the fiber reinforcement and the polymeric coating. A variety of fiber reinforcements and polymeric coating materials are suitable for FFCVs. Such materials must be capable of handling the mechanical loads and various types of extensions which will be experienced by the FFCV.

The present invention envisions a breaking tensile load that the FFCV material should be designed to handle in the range from about 1100 pounds per inch of fabric width to 2300 pounds per inch of fabric width. In addition, the coating must be capable of being folded or flexed repeatedly as the FFCV material is frequently wound up on a reel.

Suitable polymeric coating materials include polyvinyl chloride, polyurethanes, synthetic and natural rubbers, polyureas, polyolefins, silicone polymers and acrylic polymers. These polymers can be thermoplastic or thermoset in nature. Thermoset polymeric coatings may be cured via heat, room temperature curable or UV curable. The polymeric coatings may include plasticizers and stabilizers that either add flexibility or durability to the coating. The preferred coating materials are plasticized polyvinyl chloride, polyurethanes and polyureas. These materials have good barrier properties and are both flexible and durable.

Suitable fiber reinforcement materials are nylons (as a general class), polyesters (as a general class), polyaramids (such as Kevlar®, Twaron or Technora), polyolefins (such as Dyneema and Spectra) and polybenzoxazole (PBO).

Within a class of material, high strength fibers minimize the weight of the fabric required to meet the design requirement for the FFCV. The preferred fiber reinforcement materials are high strength nylons, high strength polyaramids and high strength polyolefins. PBO is desirable for it's high strength, but undesirable due to its relative high cost. High strength polyolefins are desirable for their high strength, but difficult to bond effectively with coating materials.

The fiber reinforcement can be formed into a variety of weave constructions. These weave constructions vary from a plain weave (1×1) to basket weaves and twill weaves. Basket weaves such as a 2×2, 3×3, 4×4, 5×5, 6×6, 2×1, 3×1, 4×1, 5×1 and 6×1 are suitable. Twill weaves such as 2×2, 3×3, 4×4, 5×5, 6×6, 2×1, 3×1, 4×1, 5×1 and 6×1 are suitable. Additionally, satin weaves such as 2×1, 3×1, 4×1, 5×1 and 6×1 can be employed. While a single layer weave has been discussed, as will be apparent to one skilled in the art, multi-layer weaves might also be desirable, depending upon the circumstances.

The yarn size or denier in yarn count will vary depending on the strength of the material selected. The larger the yarn diameter the fewer threads per inch will be required to achieve the strength requirement. Conversely, the smaller the yarn diameter the more threads per inch will be required to maintain the same strength. Various levels of twist in the yarn can be used depending on the surface desired. Yarn twist can vary from as little as zero twist to as high as 20 turns per inch and higher. In addition, yarn shapes may vary. Depending upon the circumstances involved, round, elliptical, flattened or other shapes suitable for the purpose may be utilized.

Accordingly, with all of the foregoing in mind, the appropriate fiber and weave may be selected along with the coating to be used.

Figure 3:
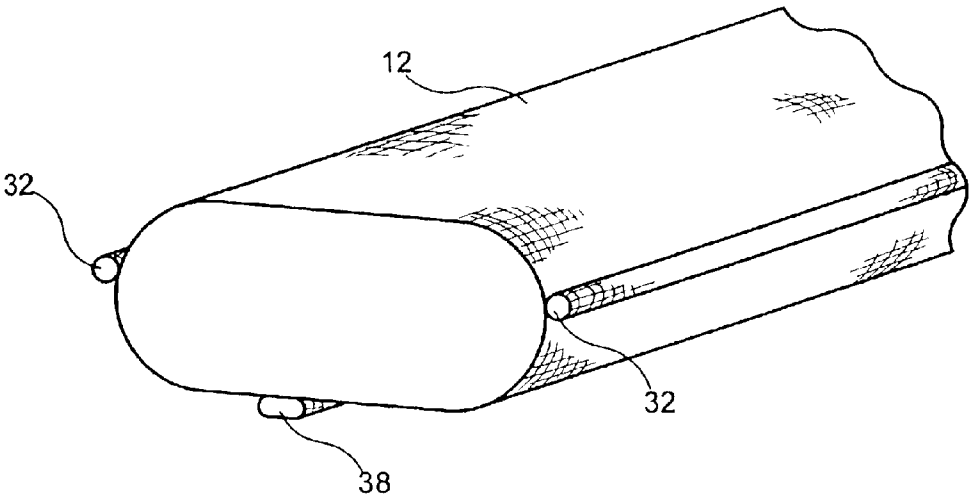
FIG. 3 is a sectional view of a FFCV having longitudinal stiffening beams incorporating the teachings of the present invention.

Returning now, however, to the structure of the FFCV 10 itself, while it has been determined that a long structure is more efficiently towed at higher speeds (greater than the present 4.5 knots), snaking in such structures is, however, a problem. To reduce the occurrence of snaking, the present invention provides for an FFCV 10 constructed with one or more lengthwise or longitudinal beams 32 that provide stiffening along the length of the tube 12 as shown in FIG. 3. In this way a form of structural lengthwise rigidity is added to a FFCV 10. The beams 32 may be airtight tubular structures made from coated fabric. When the beam 32 is inflated with pressurized gas or air, the beam 32 becomes rigid and is capable of supporting an applied load. The beam 32 can also be inflated and pressurized with a liquid such as water or other medium to achieve the desired rigidity. The beams 32 can be made to be straight or curved depending upon the shape desired for the application and the load that will be supported.

The beams 32 can be attached to the FFCV 10 or, they can be constructed as an integral part of the FFCV. In FIG. 3, two beams 32, oppositely positioned, are shown. The beams 32 can extend for the entire length of the FFCV 10 or they can extend for just a short portion of the FFCV 10. The length and location of the beam 32 is dictated by the need to stabilize the FFCV 10 against snaking. The beams 32 can be in one piece or in multiple pieces 34 that extend along the FFCV 10 (see FIG. 4).

Preferably the beam 32 is made as an integral part of the FFCV 10. In this way the beam 32 is less likely to be separated from the FFCV 10. One or more beams 32 can be woven as an integral part of a single woven tube 12 for the FFCV 10. It is possible to not only weave the tube 12 that becomes the cargo carrying space, but also simultaneously weave the tubular structure or structures that become the beam or beams 32 in the FFCV 10. Note that even in the situation where the stiffening beam is an integral part of the FFCV 10, it may still be woven of a different material or different weave than the FFCV 10, as will be apparent to the skilled artisan.

Figure 3A:
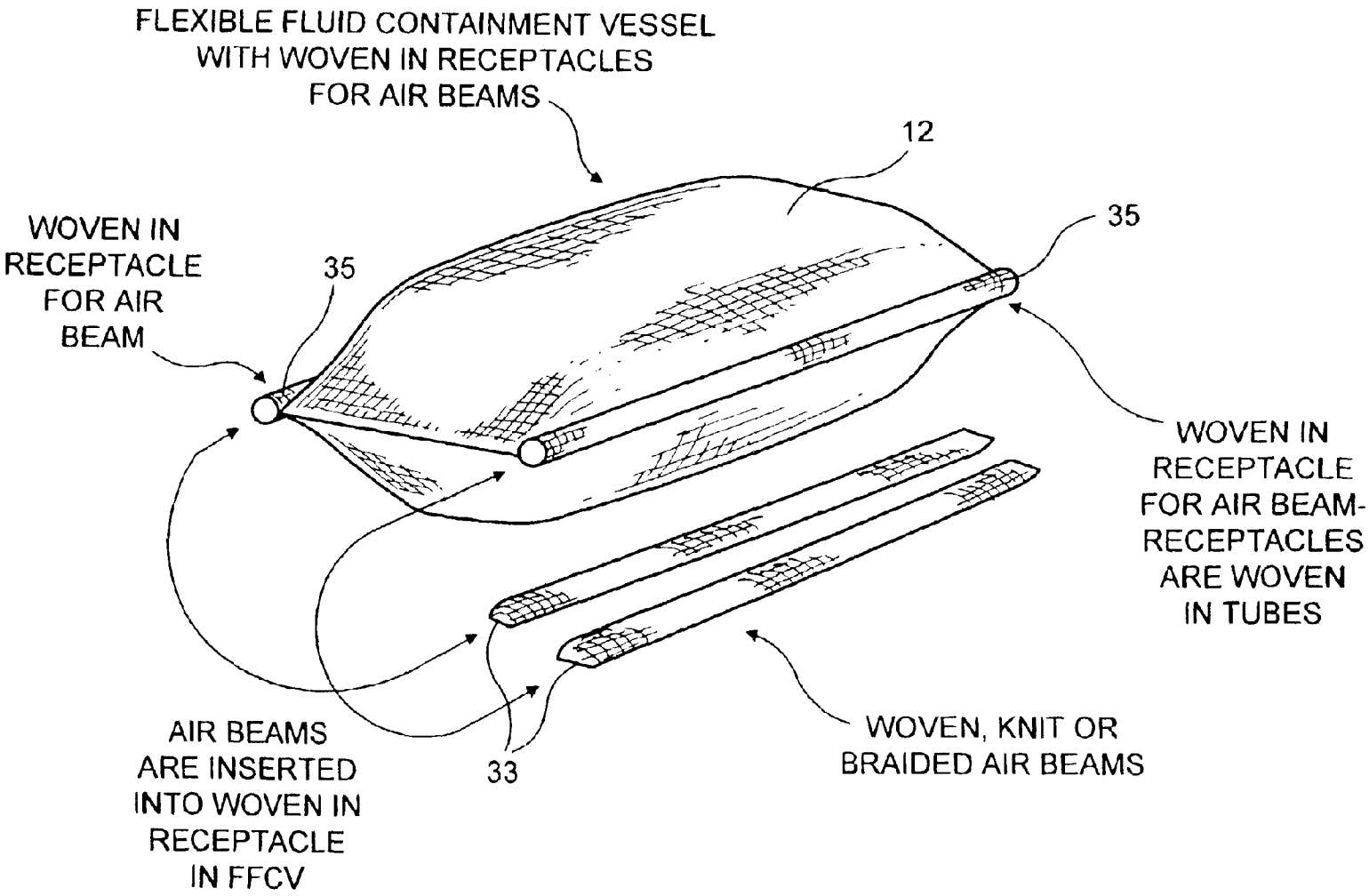
FIG. 3A is a somewhat general perspective view of a FFCV having longitudinal stiffening beams (shown detached) which are inserted in sleeves along the FFCV incorporating the teachings of the present invention.

It might also, however, be desirable to make the inflatable stiffening beams 33 as separate units and, as shown in FIG. 3A. The tubular structure could have integrally woven sleeves 35 to receive the stiffening beams 33. This allows for the stiffening beams to be made to meet different load requirements than the tubular structure. Also, the beam may be coated separately from the FFCV to render it impermeable and inflatable, allowing for a different coating for the tubular structure to be used, if so desired.

Figure 4:
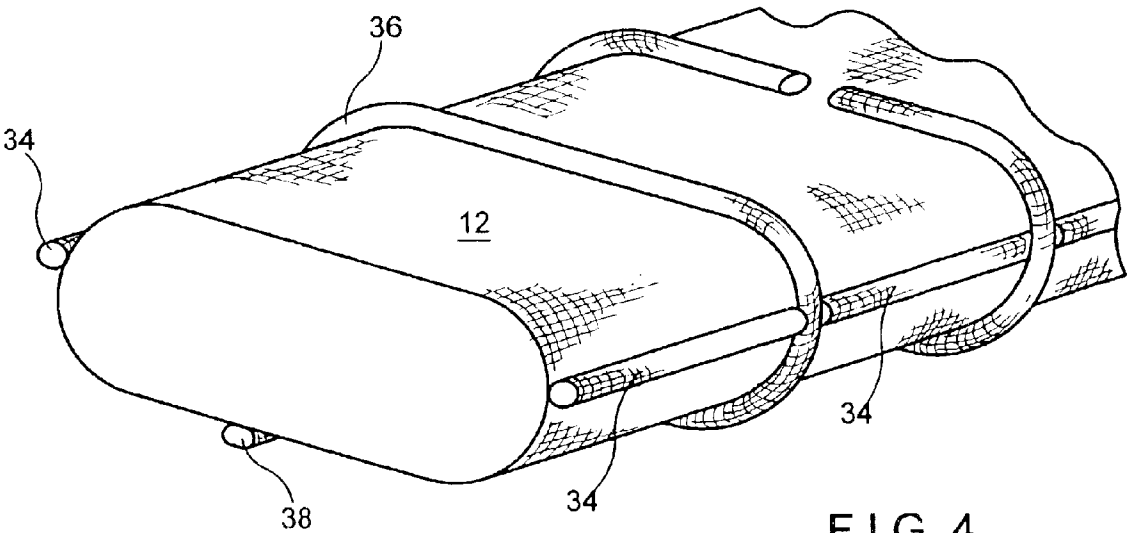
FIG. 4 is a partially sectional view of a FFCV having circumferential stiffening beams incorporating the teachings of the present invention.

Similar beams 36 can also be made to run in the cross direction to the length of the FFCV 10 as shown in FIG. 4. The beams 36 that run in the cross direction can be used to create deflectors along the side of the FFCV 10. These deflectors can break up flow patterns of salt water along the side of the FFCV 10, which, according to the prior art, leads to stable towing of the FFCV 10. See U.S. Pat. No. 3,056,373.

In addition, the beams 32 and 36, filled with pressurized air, provide buoyancy for the FFCV 10. This added buoyancy has limited utility when the FFCV 10 is filled with cargo. This added buoyancy has greater utility when the cargo is being emptied from the FFCV 10. As the cargo is removed from the FFCV 10, the beams 32 and 36 will provide buoyancy to keep the FFCV 10 afloat. This feature is especially important when the density of the FFCV 10 material is greater than salt water. If the FFCV 10 is to be wound up on a reel as the FFCV 10 is emptied, the beams 32 and 36 can be gradually deflated via bleeder valves to simultaneously provide for ease of winding and flotation of the empty FFCV 10. The gradually deflated beams 32 can also act to keep the FFCV 10 deployed in a straight fashion on the surface of the water during the winding, filling and discharging operation.

The placement or location of the beams 32 on the FFCV 10 is important for stability, durability and buoyancy of the FFCV 10. A simple configuration of two beams 32 would place the beams 32 equidistant from each other along the side of the FFCV 10 as shown in FIG. 3. If the cross sectional area of beams 32 is a small fraction of the total cross sectional area of the FFCV 10, then the beams 32 will lie below the surface of the salt water when the FFCV 10 is filled to about 50% of the total capacity. As a result the stiffening beams 32 will not be subjected to strong wave action that can occur at the surface of the sea. If strong wave action were to act on the beams 32, it is possible that the beams 32 would be damaged. Damage to the beams 32 would be detrimental to the durability of the FFCV 10. Accordingly, it is preferable that the beams 32 are located below the salt water surface when the FFCV 10 is filled to the desired carrying capacity. These same beams 32 will rise to the surface of the salt water when the FFCV 10 is emptied as long as the combined buoyancy of the beams 32 and 36 is greater than any negative buoyancy force that would cause an empty FFCV 10 to sink.

The FFCV 10 can also be made stable against rollover by placing beams in such a way that the buoyancy of the beams counteracts rollover forces. One such configuration is to have three beams. Two beams 32 would be filled with pressurized gas or air and located on the opposite sides of the FFCV 10. The third beam 38 would be filled with pressurized salt water and would run along the bottom of the FFCV 10 like a keel. If this FFCV 10 were subjected to rollover forces, the combined buoyancy of the side beams 32 and the ballast effect of the bottom beam 38 would result in forces that would act to keep the FFCV 10 from rolling over.

As aforesaid, it is preferable that the beams be an integral part of the structure of the FFCV. The weaving process therefore calls for weaving multiple tubes that are side by side with each tube having dimensions appropriate to the function of the individual tube. In this way it is possible to weave the structure as a unitized or one piece structure. A high modulus fibrous material in the weave for the beams would enhance the stiffening function of the beams. The woven structure can be coated after weaving to create the barriers to keep air, fresh water and salt water separate from each other.

The beams can also be made as separate woven, laid up, knit, nonwoven or braided tubes that are coated with a polymer to allow them to contain pressurized air or water. (For braiding, see U.S. Pat. Nos. 5,421,128 and 5,735,083 and an article entitled "3-D Braided Composite-Design and Applications" by D. Brookstein, $6^{th}$ European Conference on Composite Materials (September 1993).) If the beam is made as a separate tube, the beam must be attached to the main tube 12. Such a beam can be attached by a number of means including thermal welding, sewing, hook and loop attachments, gluing or pin seaming.

Figure 5:
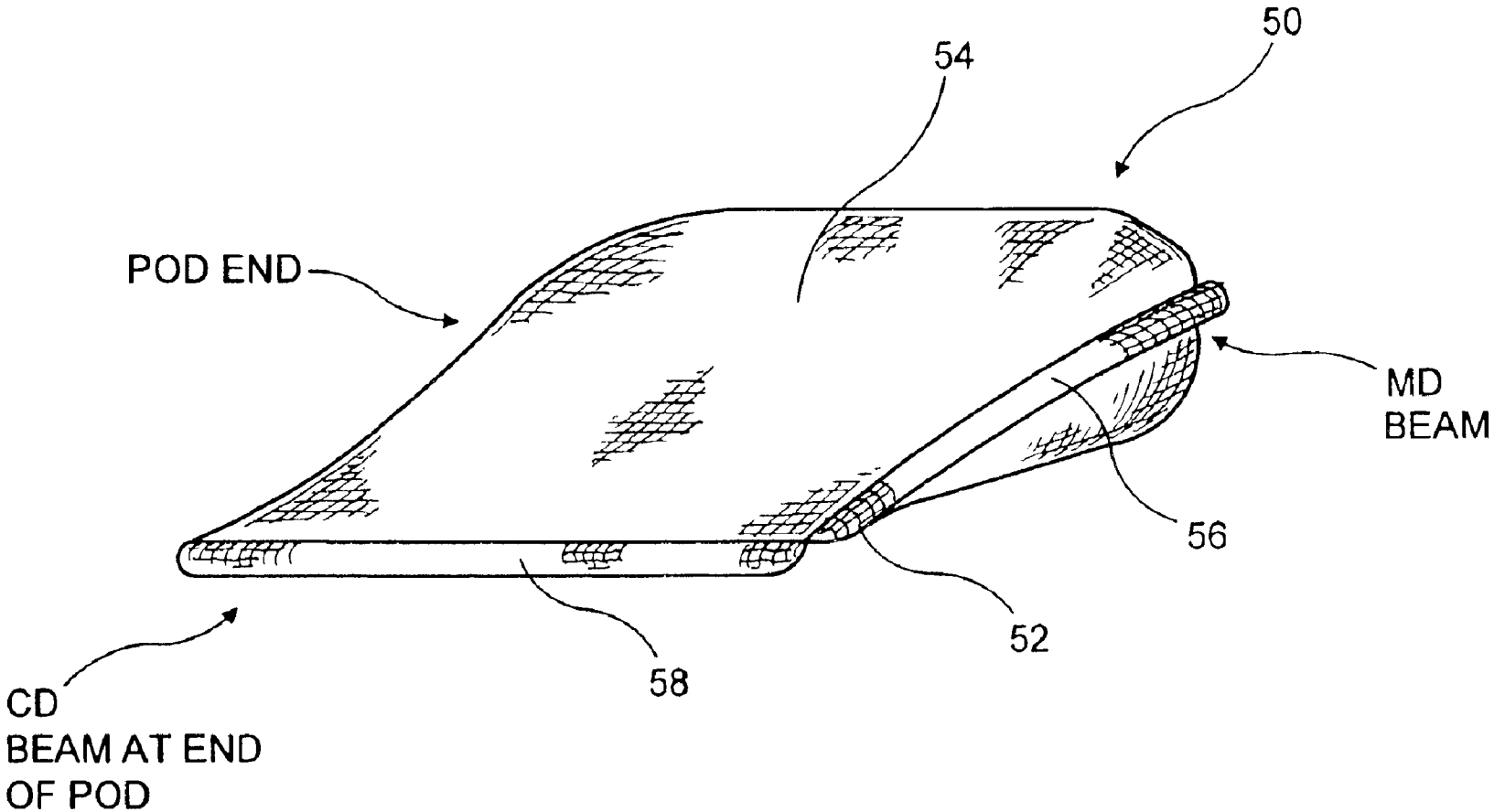
FIG. 5 is a somewhat general view of a pod shaped FFCV having a longitudinal stiffening beam and a vertical stiffening beam at its bow incorporating the teachings of the present invention.

The FFCV 10 can also take a pod shape 50 such as that shown in FIG. 5. The pod shape 50 can be flat at one end 52 or both ends of the tube while being tubular in the middle 54. As shown in FIG. 5, it may include stiffening beams 56 as previously discussed along its length and, in addition, a beam 58 across its end 52 which is woven integrally or woven separately and attached.

Figure 5A:
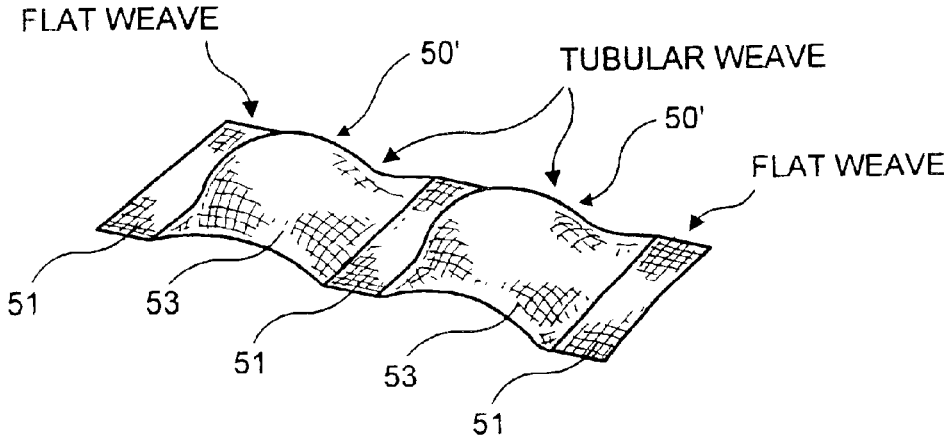
FIGS. 5A and 5B show somewhat general views of a series of pod shaped FFCVs connected by a flat woven structure, incorporating the teachings of the present invention.
Figure 5B:
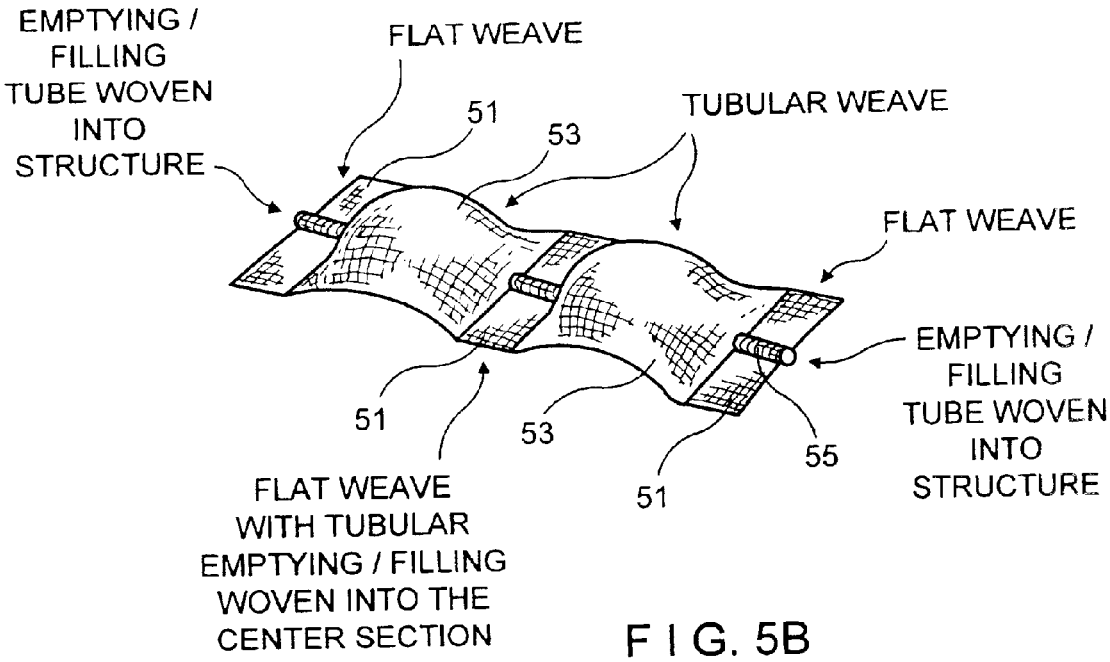

The FFCV can also be formed in a series of pods 50' woven endless or seamless, as shown in FIGS. 5A and 5B. In this regard, the pods 50' can be created by weaving a flat portion 51, then the tubular portion 53, than flat 51, then tubular 53, and so on as shown in FIG. 5A. The ends can be sealed in an appropriate manner discussed herein. In FIG. 5B there is also shown a series of pods 50' so formed, however, interconnecting the tubular portions 53 and woven therewith as part of the flat portions 51, is a tube 55 which allows the pods 50' to be filled and emptied.

Figure 6:
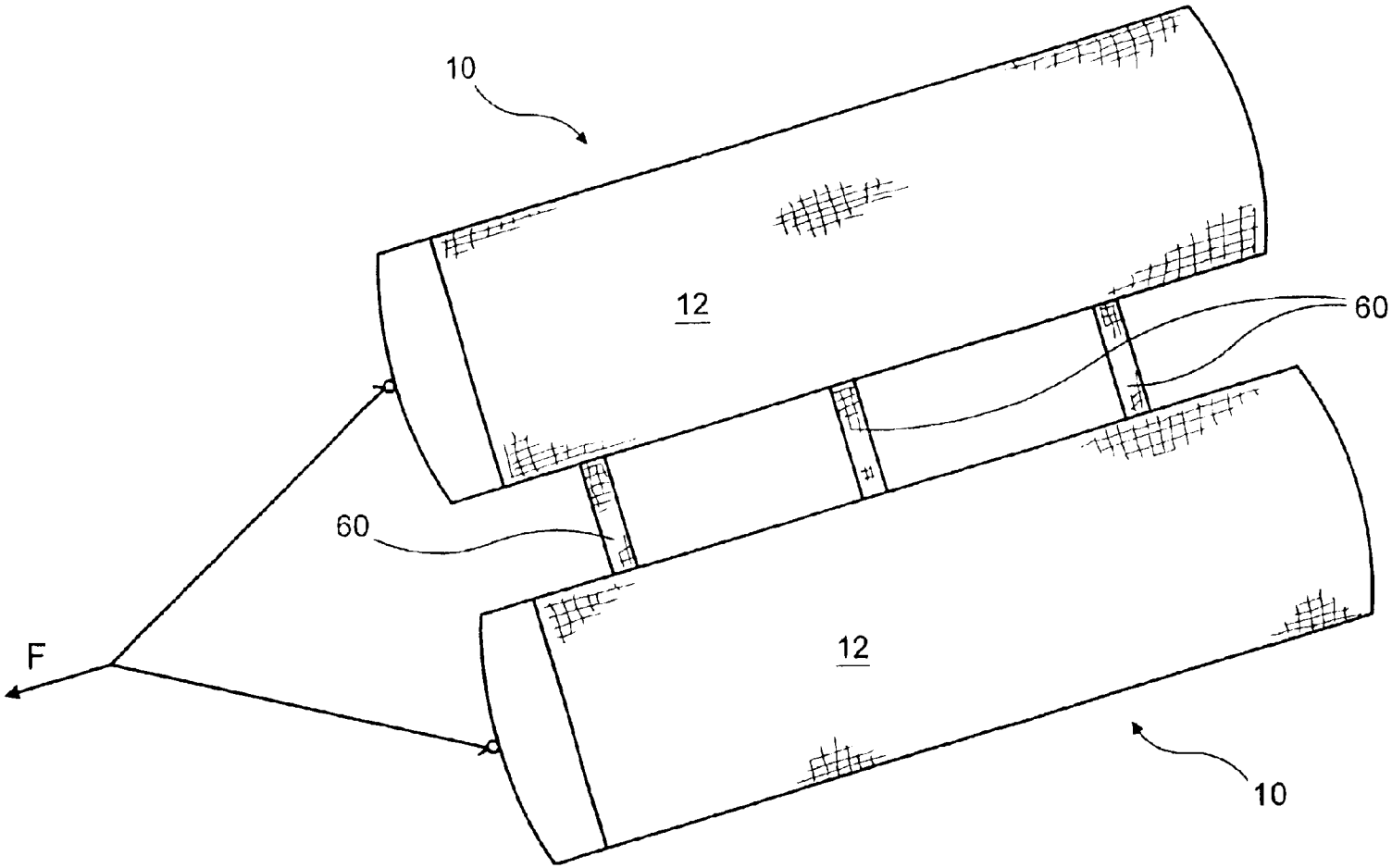
FIG. 6 is a somewhat general view of two FFCVs being towed side by side with a plurality of beam separators connected therebetween incorporating the teachings of the present invention.

Similar type beams have further utility in the transportation of fluids by FFCVs. In this regard, it is envisioned to transport a plurality of FFCVs together so as to, among other things, increase the volume and reduce the cost. Heretofore it was known to tow multiple flexible containers in tandem, side by side or in a pattern. However, in towing FFCVs side by side, there is a tendency for the ocean forces to cause lateral movement of one against the next or rollover. This may have a damaging effect on the FFCV among other things. To reduce the likelihood of such an occurrence, beam separators 60, of a construction similar to the beam stiffeners previously discussed, are coupled between the FFCVs 10 along their length as shown in FIG. 6.

The beam separators 60 could be attached by a simple mechanism to the FFCVs 10 such as by a pin seam or quick disconnect type mechanism and would be inflated and deflated with the use of valves. The deflated beams, after discharging the cargo, could be easily rolled up.

The beam separators 60 will also assist in the floatation of the empty FFCVs 10 during roll up operations, in addition to the stiffening beams 32, if utilized. If the latter was not utilized, they will act as the primary floatation means during roll up.

The beam separators 60 will also act as a floatation device during the towing of the FFCVs 10 reducing drag and potentially provide for faster speeds during towing of filled FFCVs 10. These beam separators will also keep the FFCV 10 in a relatively straight direction avoiding the need for other control mechanisms during towing.

The beam separators 60 make the two FFCVs 10 appear as a "catamaran". The stability of the catamaran is predominantly due to its two hulls. The same principles of such a system apply here.

Figure 7:
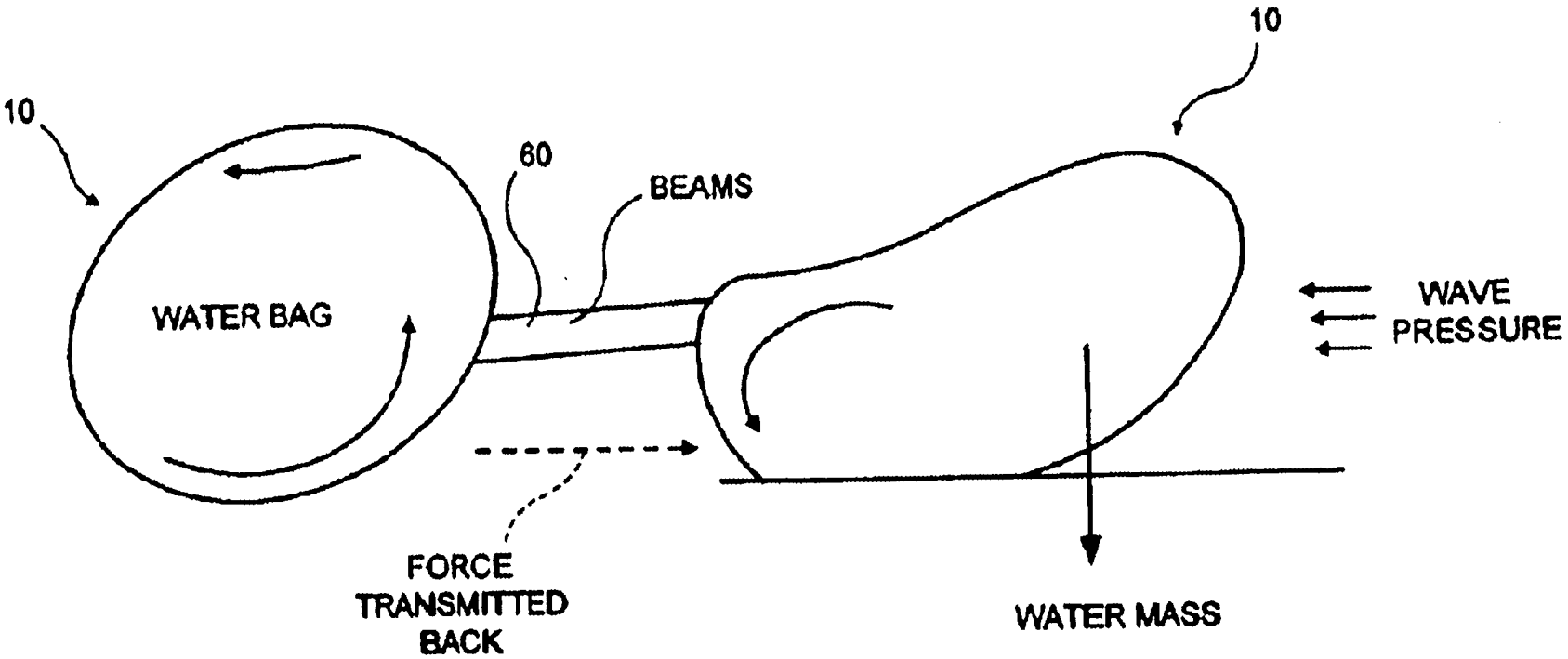
FIG. 7 is a somewhat schematic view of the force distribution on side by side FFCVs connected by beam separators incorporating the teachings of the present invention.

Stability is due to the fact that during the hauling of these filled FFCVs in the ocean, the wave motion will tend to push one of the FFCVs causing it to roll end-over-end as illustrated in FIG. 7. However, a counter force is formed by the contents in the other FFCV and will be activated to nullify the rollover force generated by the first FFCV. This counter force will prevent the first FFCV from rolling over as it pushes it in the opposite direction. This force will be transmitted with the help of the beam separators 60 thus stabilizing or self correcting the arrangement.

As has been discussed, it is important to distribute as evenly as possible the forces acting on the FFCV 10. Much of the prior art focuses especially, on the towing forces and provides for longitudinal reinforcements. This is typically addressed by providing reinforcing ropes or strips on the outside of the FFCV.

The present invention is intended to provide an improved and lower-cost option for reinforcement of FFCVs. The present invention is somewhat analogous to what is known as rip-stop fabric where the fabric is provided with reinforcement at predetermined intervals with larger and/or stronger yarn than that used in the rest of the fabric. A typical example of this is how parachutes are constructed. Such a structure not only provides for strength and tear resistance, but may allow for the reduction of the overall weight of the fabric.

In this regard, as illustrated in FIG. 2F, the present invention involves weaving tensile members 70 and 72 into the fabric of the FFCV, in at least one, but preferably both, principal fabric directions at predetermined intervals of possible one to three feet. While both directions are preferable, they need not be of the same strength in both fabric directions. A greater strength contribution may be required in the fore and aft direction. The tensile members may be larger yarns, and/or yarns of greater specific strength (strength per unit weight or unit cross-section) (e.g. Kelvar®, etc.), than the yarns that comprise most of the body of the tube. The member may be woven singly, at intervals as described, or in groups, at intervals. The reinforcing tensile members may also be rope or braid, for example.

The integrally woven tensile members 70 and 72 of the invention will reduce FFCV 10 costs by greatly simplifying fabrication. All steps associated with measuring, cutting, and attaching reinforcing members will be eliminated. The integrally woven reinforcements 70 and 72 will also contribute more to the overall structural integrity of FFCVs because they can be located optimally without regard for fabrication details. In addition to contributing the desired tensile strength, the integrally woven members 70 and 72 will improve tear resistance and reduce the probability of failure or failure propagation upon impact with floating debris.

A skilled worker in the art will appreciate the selection of the reinforcement material used and the intervals or spacing selected will depend upon, among other things, the towing forces involved, the size of the FFCV, the intended cargo and amount thereof, hoop stresses, along with cost factors and the desired results. Implementation and incorporation of the reinforcing material into the integral weave may be accomplished by existing weaving technology known, for example, in the papermaking cloth industry.

Figure 10:
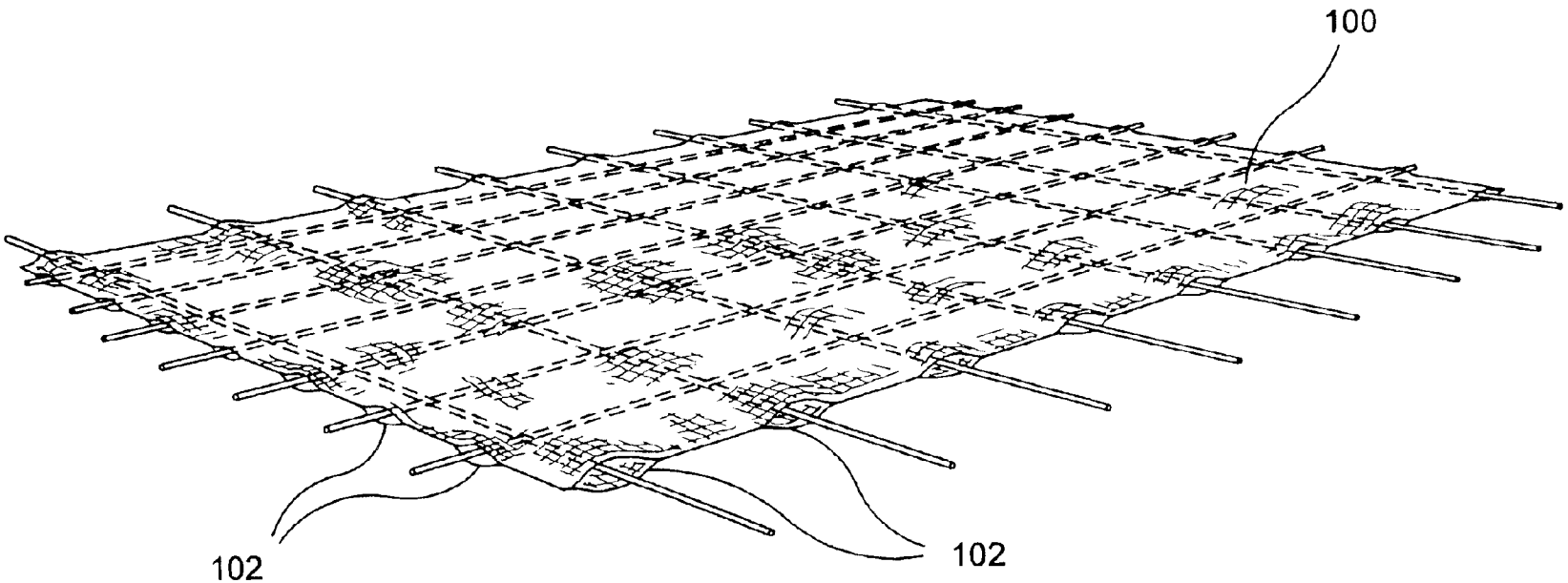
FIGS. 10, 10A and 10B are perspective views of an alternative form of the tube portion of the FFCV having woven pockets for receiving reinforcing members incorporating the teachings of the present invention.
Figure 10A:
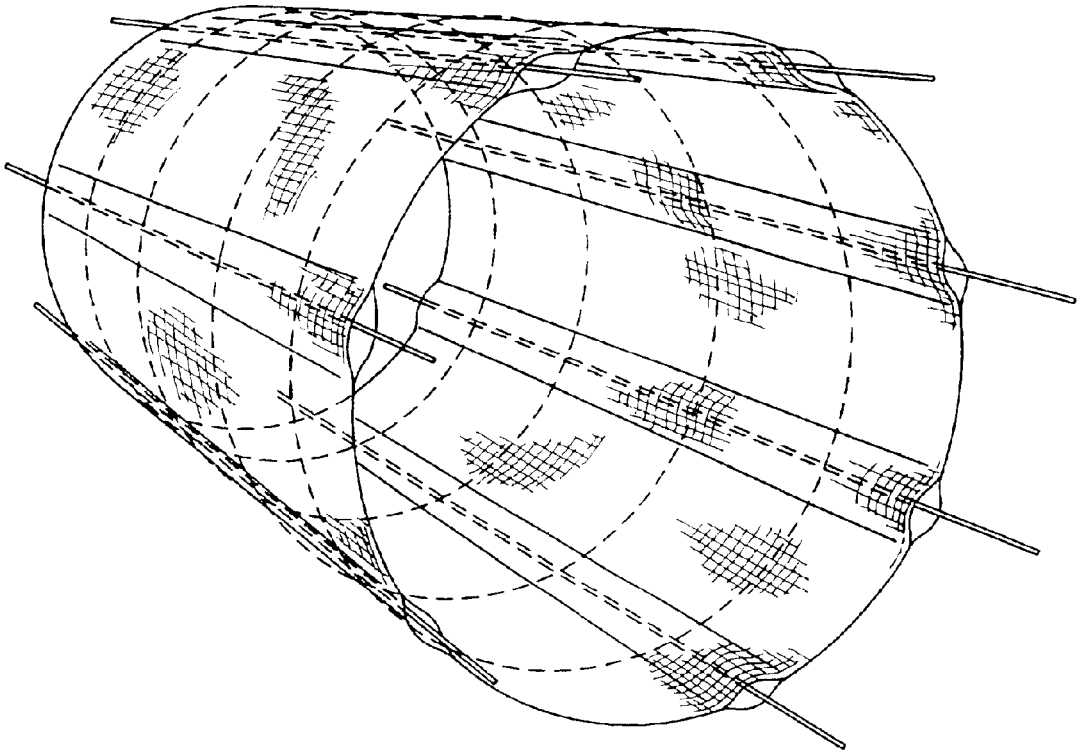
Figure 10B:
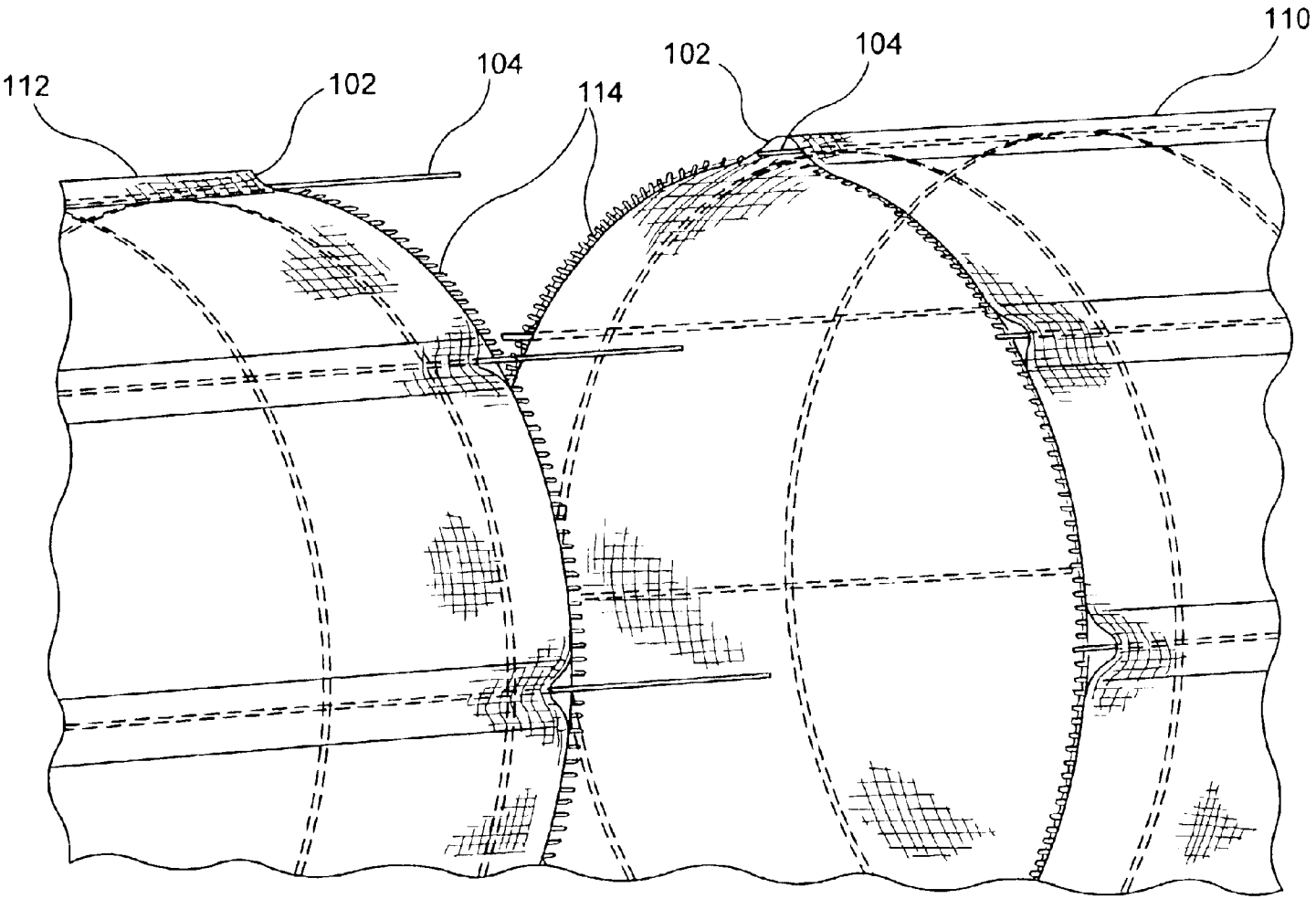

An alternative manner of reinforcing the FFCV is that shown in FIGS. 10–10B. In this regard the FFCV may be formed out of a woven fabric 100 which may be woven flat as shown in FIG. 10. In such a case, the fabric 100 would ultimately be joined together to create a tube with an appropriate water tight seam along its length. Any seam suitable for purpose may be utilized such as a water tight zipper, a foldback seam, or a pin seam arrangement, for example. Alternatively, it may be woven tubular as shown in FIG. 10A. The fabric would be impermeable and have suitable end portions as have been described with regard to other embodiments herein.

As distinct therefrom, the fabric 100 would include woven pockets 102 which can be along its length, circumference, or both. Contained within the pockets 102 would be suitable reinforcement elements 104 and 106 such as rope, wire or other type suitable for the purpose. The number of pockets and spacing would be determined by the load requirements. Also, the type and size of the reinforcement elements 104 and 106 which are placed in the pockets 102 can be varied depending upon the load (e.g. towing force, hoop stress, etc.). The longitudinal reinforcing element 104 would be coupled at their ends to suitable end caps or tow bars, for example. The radial or circumferential reinforcing elements 106 would have their respective ends suitably joined together by clamping, braiding or other means suitable for the purpose.

By the foregoing arrangement, the load on the FFCV is principally on the reinforcing elements 104 and 106 with the load on the fabric being greatly reduced, thus allowing for, among other things, a lighter weight fabric. Also, the reinforcing elements 104 and 106 will act as rip stops so as to contain tears or damage to the fabric.

As shown in FIG. 10B, an FFCV can be fabricated in sections 110 and 112 and constructed with the pockets 102 aforedescribed. These sections 110 and 112 can then be joined together by way of loops 114 placed at the ends thereof to create a type of pin seam which would then be rendered impervious by way of a coating thereof. A water impermeable zipper may also be used, in addition to any other fabric joining technique suitable for the purpose such as a foldback seam or other seams used in, for example, the papermaking industry. In addition, the respective reinforcing members 104 would be coupled together in a suitable manner so as to convey the load therebetween.

Turning now to a method of rendering such a large structure impermeable, there are several ways to accomplish this.

One means for coating does not require that the inner surface of the tube be accessible. This means would utilize an inexpensive film or liner (such as polyethylene). This film or non-stick liner would be inserted in the inner surface of the tube during the weaving process. This can be done by stopping the loom during weaving of the tubular section and inserting the film into the tube via access gained between warp yarns located between the already woven fabric and the beat-up bar of the loom. This insertion process would probably have to be repeated many times during the weaving process in order to line the inner surface of the tube. Once the film has been inserted on the inside surface of the tube, the structure is sealed and the entire structure can be dip coated; spray coated or coated by some other means such that the woven base fabric is impregnated with the desired coating. The resin-impregnated structure is cured to an extent such that, via an opening cut in the tube surface, the film can be removed, the tube partially or totally inflated via pressurized air, and the curing process completed, if required. The film serves to prevent the coating resin from adhering one inner surface of the tube to another inner surface of the tube.

Another method for coating the tube is to dip coat or spray coat the entire structure without any provision being made for preventing the inner surfaces of the tube from contacting each other i.e., without lining the inner surface of the tube with a film or liner. It is possible to weave a structure such that the coating does not pass completely through the fabric, yet the coating penetrates the woven fabric such that the coating adheres to the fabric. This approach allows one to coat the structure and create a coated tube without concern for the inner surfaces adhering to each other.

Another approach involves the use of a fabric design in which the coating passes through the fabric and the inner surfaces do bond to each other upon coating. In this case, one would insert a manhole size piece of metal or plastic film between the inner surfaces of the tube before coating and before or after sealing the ends of the tube. If after, this piece of metal or plastic film would be inserted through a small hole cut in the woven tube. After coating one would insert or connect a pressurized air line to the space or gap created between the metal or plastic film and a coated surface of the tube. This pressurized air would be used to force the two inner surfaces of the tube away from each other i.e., expand the tube. In doing so the coating that bonds the two inner surfaces would fail in a peeling fashion until the entire inner surfaces of the tube are freed from each other. This approach requires a coating resin that can readily fail in a peeling mode of failure. While coating resins are usually designed to resist peeling, curable resins are susceptible to peeling failure when they are only partially cured. The present invention envisions a process whereby the tubular structure is coated, the coating is partially cured such that the coating no longer flows, forces are then applied while the coating is susceptible to peeling failure such that the inner surfaces are freed from each other. If desired, the inside of the expanded tube may now also be coated.

A further method for coating the tube is to spray coat the structure while making some provision to make sure that the inner surfaces of the tube are not in contact with each other. One way to do this is to inflate the tube with air and coat the structure while air holds the inner surfaces apart. This method depends upon the woven structure having a low permeability to air such that the tube can be inflated by inserting a pressurized air line into the tube. Alternatively, one can erect a scaffold within the tube. Such a scaffold might be a metal support structure or a rigid or semi-rigid tube or slinky type structure (with or without a membrane thereabouts) which will approximate the diameter of the inside of the tube and may be sized to allow it to be movable from section to section that is being coated. The scaffold could also be an inflatable arch or tube that is placed inside the tube. Such scaffolds would be placed inside the tube via a manhole sized access point that is cut in the woven tube surface. Once the scaffold is in place, it may be suitable to spray coat the structure from the outside of the tube, the inside of the tube, or both the inside and outside of the tube.

Note that the inflated arch or tube method may actually use the stiffening beams discussed previously. In this regard, such beams could be first made impermeable by being coated and then inflated to support the tube's expanded shape. Coating of the tube's both inner and outer surface can then be accomplished.

A still further method of coating is envisioned. In this regard, an elastic bladder having an outer circumference slightly less than the inner circumference of the tube is fabricated from an impermeable material. It's axial length would be equal to part or whole of the length of the tube. The outer surface of the bladder would have the characteristics of "release or non-adherence" to the resin or other material that will be used to coat and/or impregnate the tube. This can be accomplished by selecting the proper material for the bladder itself or applying a coating on the outside of the bladder. The bladder is placed inside the tube and is then inflated using a gas or liquid so it expands against the inner surface of the tube. The circumference of the bladder when inflated is such that it would apply circumferential tension to the tube along the full axial length of the bladder. A coating can then be applied to the exterior of the tube in the area where it is held under circumferential tension by the bladder. Hand application, spraying, or any other known application technique can be used to apply the coating. If the bladder axial length is less than the axial length of the tube, the bladder can be deflated after application of the coating and relocated to an uncoated length of the tube and the steps are repeated. Due to the "release or non-adherence" surface, the bladder does not "stick" to the coating that may pass through the tube. After the entire circumferential and axial length of the tube has been coated, the bladder is removed. At this point, if it is desired to coat the inside of the tube, the tube can be assembled and sealed at its ends and inflated. The inside of the tube can now be coated. Note, in all cases where the tube is coated on the inside and outside, the coatings used for each should be compatible to create proper bonding.

A yet further method for coating the tube employs a thermoplastic composite approach. In this approach the tube is woven from a mixture of at least two fibrous materials. One material would be the reinforcing fiber and the second material would be a low melting fiber or low melting component of a reinforcing fiber. The low melting fiber or component might be a thermoplastic polyurethane or polyethylene. The reinforcing fiber might be polyester or nylon tire cord or one of the other fiber hereinbefore discussed. The tube would be subjected to heat and pressure in a controlled fashion. This heat and pressure would cause the low melting fiber or component to melt and fill the void in the woven structure. After the heat and pressure are removed and the structure is cooled, a composite structure would form in which the low melting fiber or component has become the matrix for the reinforcing fiber. This approach requires applying heat and pressure while also providing a means to keep the inner surfaces of the tube from adhering or thermally bonding to each other.

Figure 8:
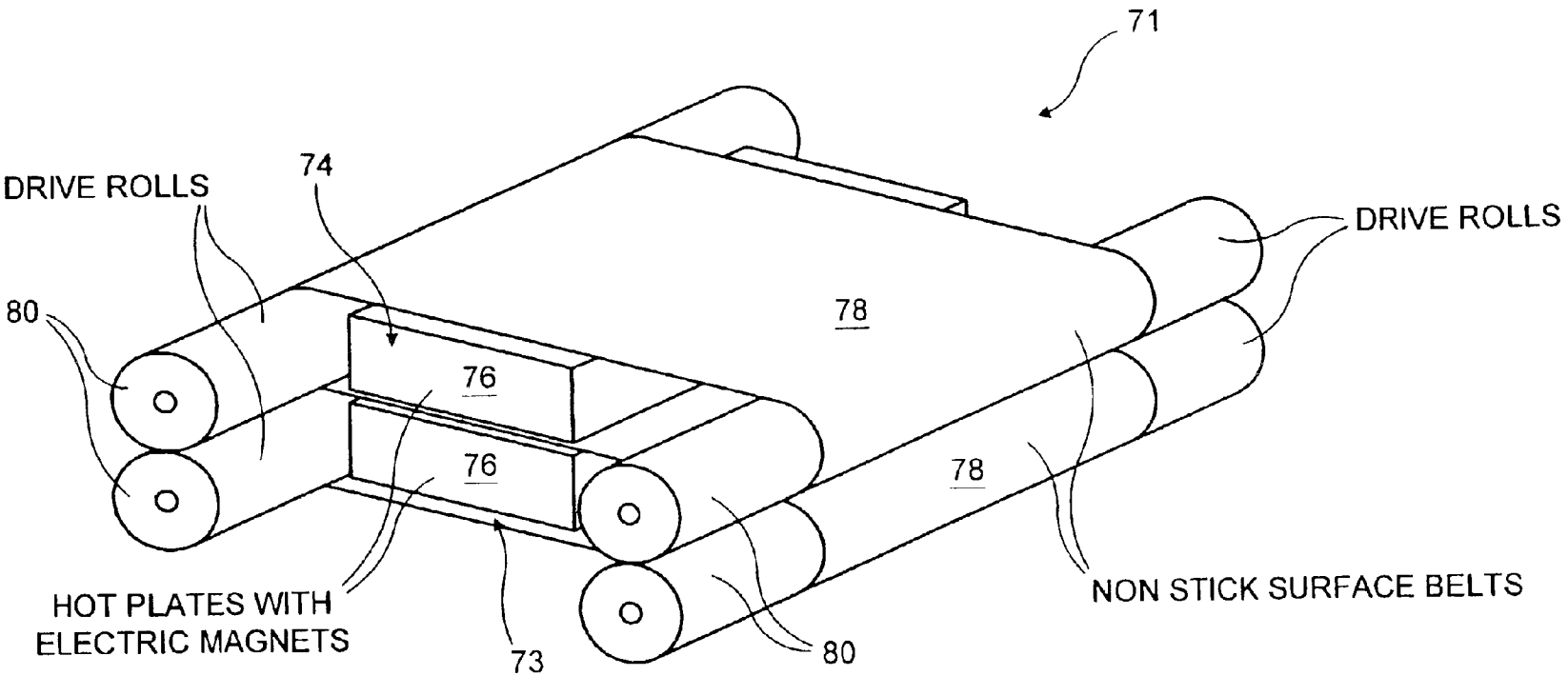
FIG. 8 is a perspective view of a device for applying heat and pressure to a tube which is to be used in an FFCV incorporating the teachings of the present invention.
Figure 9:
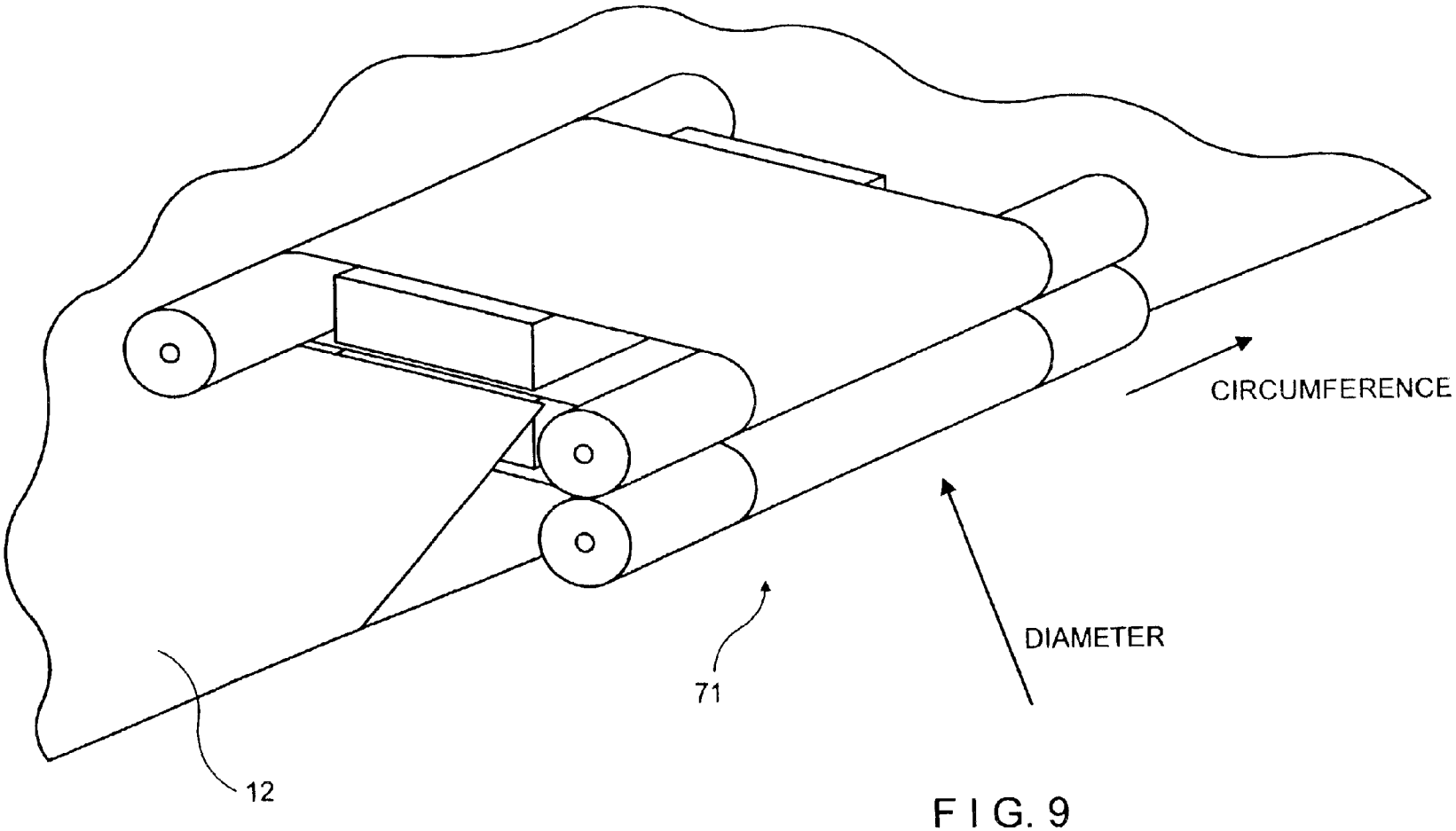
FIG. 9 is a perspective view of the device shown in FIG. 8 in conjunction with the tube incorporating the teachings of the present invention.

FIGS. 8 and 9 show a device 71 which can apply heat and pressure to the tube 12. The device 71 can be self-propelled or can be moved by external pulling cables. Each section 73 and 74 of the device includes heating or hot plates with respective magnets 76 and motors (not shown) and are positioned on either side of the fabric as shown in FIG. 9. A power supply (not shown) is provided to energize the heating plates 76 and supply power to the motors that propel the device across the tube 12. The magnets serve to pull the two hot plates 76 together which creates pressure to the fabric as the coating on the yarn liquefies from the heat. These magnets also keep the top heating plate 76 opposite to the inside heating plate 76. The device 71 includes endless non-stick belts 78 that ride on rollers 80 located at the plate ends. The belts 78 ride over the plates 76. In this way there is no movement of the belt 78 in relation to the fabric surface when it is in contact with the fabric. This eliminates smearing of the melted coating and uniform distribution between the yarns. The device moves across the length of the tube 12 at a speed that enables the melted coat to set prior to the fabric folding back upon itself and sticking. If faster speeds are desired, a means for temporarily keeping the inside surfaces apart while setting takes place, may be implemented. This may be, for example, a trailing member on the inside of the tube of similar design to that described but being only one section without, of course, a heating plate or magnet. Other means suitable for this purpose will be readily apparent to those skilled in the art.

As part of the coating process there is envisioned the use of a foamed coating on the inside or outside or both surfaces of the tube. A foamed coating would provide buoyancy to the FFCV, especially an empty FFCV. An FFCV constructed from materials such as, for example, nylon, polyester and rubber would have a density greater than salt water. As a result the empty FFCV or empty portions of the large FFCV would sink. This sinking action could result in high stresses on the FFCV and could lead to significant difficulties in handling the FFCV during filling and emptying of the FFCV. The use of a foam coating provides an alternative or additional means to provide buoyancy to the FFCV to that previously discussed.

Also, in view of the closed nature of the FFCV, if it is intended to transport fresh water, as part of the coating process of the inside thereof, it may provide for a coating which includes a germicide or a fungicide so as to prevent the occurrence of bacteria or mold or other contaminants.

In addition, since sunlight also has a degradation effect on fabric, the FFCV may include as part of its coating or the fiber used to make up the FFCV, a UV protecting ingredient in this regard.

Although preferred embodiments have been disclosed and described in detail herein, their scope should not be limited thereby rather their scope should be determined by that of the appended claims.

We claim:

1. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization by selective inflation and deflation with a pressurized gas or liquid independent of a pressure of the vessel.

2. The vessel in accordance with claim 1 which includes a plurality of longitudinal stiffening beams.

3. The vessel in accordance with claim 2 which includes at least two longitudinal stiffening beams positioned equidistant from each other on the tubular structure.

4. The vessel in accordance with claim 3, further comprising a third longitudinal stiffening beam positioned intermediate to said at least two longitudinal stiffening beams, with said third beam being so positioned as to provide ballast when filled, and wherein said longitudinal stiffening beams are fillable.

5. The vessel in accordance with claim 2 wherein said stiffening beams are continuous.

6. The vessel in accordance with claim 2 wherein said stiffening beams are made in sections.

7. The vessel in accordance with claim 1 wherein the means for sealing an end of the tubular structure comprises an end cap made of rigid material secured to a perimeter of the tubular structure defining its circumference so as to evenly distribute forces thereon.

8. The vessel in accordance with claim 1 wherein the tubular structure is woven with fiber reinforcements with the weave used taken from the group consisting essentially of: plain weave (1×1); basket weaves including 2×2, 3×3, 4×4, 5×5, 6×6, 2×1, 3×1, 4×1, 5×1, 6×1; twill weaves including 2×2, 3×3, 4×4, 5×5, 6×6, 2×1, 3×1, 4×1, 5×1, 6×1; and satin weaves including 2×1, 3×1, 4×1, 5×1 and 6×1.

9. The vessel in accordance with claim 8 wherein the fiber reinforcements are made of a material taken from the group consisting essentially of: nylon, polyesters, polyaramids, polyolefins and polybenzoxazole.

10. The vessel in accordance with claim 9 wherein said means for rendering said tubular structure impervious includes a coating material on the fabric on one or both sides thereof.

11. The vessel in accordance with claim 10 wherein said coating material is taken from the group consisting essentially of: polyvinyl chloride, polyurethane, systhetic and natural rubbers, polyureas, polyoefins, silicone polymers, acrylic polymers or foam derivatives thereof.

12. The vessel in accordance with claim 9 wherein the means for rendering the tubular structure impervious weaving the tubular structure with at least two materials, one being a reinforcing fiber, the other being a low melting fiber or low melting component of the fiber reinforcement such that a processing thereof causes the low melting fiber or component to fill a void in the fabric.

13. The vessel in accordance with claim 1 wherein the tubular structure is woven with fiber reinforcements which are made of a material taken from the group consisting essentially of: nylon, polyesters, polyaramids, polyolefins and polybenzoxazole.

14. The vessel in accordance with claim 1 wherein said means for rendering said tubular structure impervious includes a coating material on the fabric on one or both sides thereof.

15. The vessel in accordance with claim 14 wherein said coating material is taken from the group consisting essentially of: polyvinyl chloride, polyurethane, synthetic and natural rubbers, polyureas, polyolefins, silicone polymers, acrylic polymers or foam derivatives thereof.

16. The vessel in accordance with claim 1 wherein the means for rendering the tubular structure impervious includes weaving the tubular structure with at least two materials, one being a reinforcing fiber, the other being a low melting fiber or low melting component of the reinforcing fiber such that a processing thereof causes the low melting fiber or component to fill the void in the fabric.

17. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization and which includes at least one flexible circumferential stiffening beam positioned about a circumference of the tubular structure and integrally formed therewith and being subject to pressurization and depressurization.

18. The vessel in accordance with claim 17 which includes plurality of said circumferential stiffening beams.

19. The vessel in accordance with claim 17 wherein said at least one flexible circumferential stiffening beam is continuous.

20. The vessel in accordance with claim 17 said at least one flexible circumferential stiffening beam is in sections.

21. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization and wherein said front end and said rear end are collapsed upon themselves into a flatten, folded structure, sealed and secured mechanically.

22. The vessel in accordance with claim 21 which includes providing a pin seam at an end so as to allow the coupling of a tow bar or another vessel thereto.

23. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization and wherein said front end and said rear end are collasped, folded and sealed such that the width of the collapsed and folded front end and rear end are approximately that of the diameter of the tubular structure.

24. The vessel in accordance with claim 23 which includes a rigid tongue member which is contoured to match the end of the tubular structure and to which the end of the tubular structure is sealed.

25. The vessel in accordance with claim 24 wherein the means for emptying and filling the cargo is located on the tongue member.

26. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization and wherein the tubular structure is pod shaped having at least one end which is collapsed and sealed and includes a vertical flexible stiffening beam at the one end, which is subject to pressurization and depressurization.

27. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being integral with said tubular structure and subject to pressurization and depressurization and which includes at least two vessels positioned in a side by side relationship, a plurality of beam separators positioned between and coupled to said two vessels, said plurality of beam separators being made of flexible material and subject to pressurization and depressurization.

28. The vessel in accordance with claim 27 wherein said beam separators are made of a woven material.

29. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and means for reinforcing the tubular structure by weaving in integrally as part of the fabric thereof reinforcement elements at predetermined intervals along a longitudinal length of the tubular structure; and wherein said reinforcing means further comprises reinforcing elements that are woven in integrally as part of the fabric at predetermined intervals along a circumference of the tubular structure.

30. The vessel in accordance with claim 29 wherein the reinforcing element is taken from the group consisting essentially of: yarns of larger size than yarns that make up the majority of the tubular structure, yarns of higher specific strength than yarns that make up the majority of the tubular structure, rope and braid.

31. The vessel in accordance with claim 29 wherein the reinforcing element along a longitudinal length and along a circumference of the tubular structure is taken from the group consisting essentially of: yarns of larger size than yarns that make up the majority of the tubular structure, yarns of higher specific strength than yarns that make up the majority of the tubular structure, rope and braid.

32. The vessel in accordance with claim 29 wherein the means for sealing an end of the tubular structure comprises an end cap made of rigid material secured to a perimeter of the tubular structure deafening its circumference so as to evenly distribute forces thereon.

33. The vessel in accordance with claim 29 wherein the tubular structure is woven with fiber reinforcements with the weave used taken from the group consisting essentially of: plain weave (1×1); basket weaves including 2×2, 3×3, 4×4, 5×5, 6×6, 2×1, 3×1, 4×1, 5×1, 6×1; twill weaves including 2×2, 3×3, 4×4, 5×5, 6×6, 2×1, 3×1, 4×1, 5×1, 6×1; and satin weaves including 2×1, 3×1, 4×1, 5×1 and 6×1.

34. The vessel in accordance with claim 33 wherein the fiber reinforcements are made of a material taken from the group consisting essentially of: nylon, polyesters, polyaramids, polyolefins and polybenzoxazole.

35. The vessel in accordance with claim 34 wherein said means for rendering said tubular structure impervious includes a coating material on the fabric on one or both sides thereof.

36. The vessel in accordance with claim 29 wherein the tubular structure is woven with fiber reinforcements which are made of a material taken from the group consisting essentially of: nylon, polyesters, polyaramids, polyolefins and polybenzoxazole.

37. The vessel in accordance with claim 29 wherein said means for rendering said tubular structure impervious includes a coating material on the fabric on one or both sides thereof.

38. The vessel in accordance with claim 37 wherein said coating material is taken from the group consisting essentially of: polyvinyl chloride, polyurethane, synthetic and natural rubbers, polyureas, polyolefins, silicone polymers, acrylic polymers or foam derivatives thereof.

39. The vessel in accordance with claim 29 wherein the means for rendering the tubular structure impervious includes weaving the tubular structure with at least two materials, one being a reinforcing fiber, the other being a low melting fiber or low melting component of the reinforcing fiber such that a processing thereof causes the low melting fiber or component to fill the void in the fabric.

40. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and means for reinforcing the tubular structure by weaving in integrally as part of the fabric thereof reinforcement elements at predetermined intervals along a longitudinal length of the tubular structure; and wherein said front end and said rear end are collapsed upon themselves into a flatten, folded structure, it sealed and secured mechanically.

41. The vessel in accordance with claim 40 which includes providing a pin seam at an end so as to allow the coupling of a tow bar or another vessel thereto.

42. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and means for reinforcing the tubular structure by weaving in integrally as part of the fabric thereof reinforcement elements at predetermined intervals along a longitudinal length of the tubular structure; and wherein said front end and rear end are collapsed, folded and sealed such that the width of the collapsed and folded front end and rear end are approximately that of the diameter of the tubular structure.

43. The vessel in accordance with claim 42 which includes a rigid tongue member which is contoured to match the end of the tubular structure and to which the end of the tubular structure is sealed.

44. The vessel in accordance with claim 43 wherein the means for emptying and filling the cargo is located on the tongue member.

45. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and means for reinforcing the tubular structure by weaving in integrally as part of the fabric thereof reinforcement elements at predetermined intervals along a longitudinal length of the tubular structure; and wherein the tubular structure is pod shaped having at least one end which is collapsed and sealed and includes a vertical flexible stiffening beam at the one end, which is subject to pressurization and depressurization.

46. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and wherein the means for sealing the from end includes collapsing, folding, and sealing the front end of the tubular structure in such a manner so as to create a bow like structure at the front end which is perpendicular to the surface of the water in which the vessel floats.

47. The vessel in accordance with claim 46 wherein said means for sealing said front end further includes securing said front end mechanically.

48. The vessel in accordance with claim 46 wherein said means for sealing said rear end includes collapsing, folding, and sealing the rear end of the tubular structure.

49. The vessel in accordance with claim 48 wherein said means for sealing said rear end further includes securing said rear end mechanically.

50. The vessel in accordance with claim 48 wherein the rear end is in a plane and the front end is in a plane which is orthogonal to the rear plane.

51. A flexible fluid containment vessel for the transportation and/or containment of cargo comprising a fluid or fluidisable material, said vessel comprising:

at least two elongated flexible tubular structures of woven seamless fabric;

means for rendering said tubular structures impervious to water and other fluids having a density less than that of salt water;

said tubular structures having a respective front end and a rear end;

means for sealing said respective front end and said rear end;

means for filling and emptying said vessel of cargo;

means for connecting said tubular structures together in a series comprising a woven flat fabric woven seamless with said tubular structures and positioned there between, and at least one flexible longitudinal stiffening beam positioned along the length of said tubular structures and subject to pressurization and depressurization by selective inflation and deflation with a pressurized gas or liquid.

52. The vessel in accordance with claim 51 wherein said means for filling and emptying comprises a tube woven seamless with said tubular structures allowing fluid communication therebetween.

53. The vessel in accordance with claim 52 wherein said means for filling and emptying further comprises a tube woven seamless to a respective front end of one of the tubular structures and a respective rear end of the other of the tubular structures.

54. The vessel in accordance with claim 51 wherein the tubular structures are pod shaped.

55. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo;

and at least one flexible longitudinal stiffening beam positioned along a length of said tubular structure for dampening undesired oscillation of said tubular structure, said stiffening beam being maintained within a sleeve woven seamless with said tubular structure along a length thereof to reduce drag, and subject to pressurization and depressurization by selective inflation and deflation with a pressurized gas or liquid.

56. The vessel in accordance with claim 55 which includes a plurality of longitudinal stiffening beams and a plurality of sleeves.

57. The vessel in accordance with claim 56 which includes at least two longitudinal stiffening beams positioned equidistant from each other on the tubular structure which are maintained in respective sleeves.

58. The vessel in accordance with claim 56 wherein said stiffening beams are continuous and said sleeves are continuous.

59. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and a plurality of longitudinal pockets integrally formed with said fabric containing respective longitudinal reinforcing elements positioned along a length of said tubular structure for reinforcing said fabric and receiving a longitudinal force thereon; and wherein said fabric includes a plurality of circumferential pockets having respective circumferential reinforcing elements therein positioned about a circumference of the tubular structure and integrally formed therewith.

60. A flexible fluid containment vessel for the transportation and/or containment of cargo comprising a fluid or fluidisable material, said vessel comprising:

an elongated flexible tubular structure of woven seamless fabric;

means for rendering said tubular structure impervious;

said tubular structure having a front end and a rear end;

means for sealing said front end and said rear end;

means for filling and emptying said vessel of cargo; and a plurality of longitudinal pockets integrally formed with said fabric containing respective longitudinal reinforcing elements positioned along a length of said tubular structure for reinforcing said fabric and receiving a longitudinal force thereon; wherein said fabric is continuous and seamless; and wherein said fabric includes a plurality of circumferential pockets having respective circumferential reinforcing elements therein positioned about a circumference of the tubular structure and integrally formed therewith.

61. A flexible fluid containment vessel for the transportation and/or containment of cargo comprising a fluid or fluidisable material, said vessel comprising:

an elongated flexible tubular structure of woven fabric;

means for rendering said tubular structure impervious;

said tubular structure having a front end and a rear end;

means for sealing said front end and said rear end;

means for filling and emptying said vessel of cargo;

a plurality of longitudinal pockets integrally formed with said fabric containing respective longitudinal reinforcing elements positioned along a length of said tubular structure for reinforcing said fabric and receiving a longitudinal force thereon; wherein said fabric is made in sections and joined together; and wherein said fabric includes a plurality of circumferential pockets having respective circumferential reinforcing elements therein positioned about a circumference of the tubular structure.

* * * * *